US006919012B1

(12) United States Patent
Bucar

(10) Patent No.: US 6,919,012 B1
(45) Date of Patent: Jul. 19, 2005

(54) METHOD OF MAKING A COMPOSITE ARTICLE COMPRISING A CERAMIC COATING

(75) Inventor: Sergiu Bucar, Kishenyev (MD)

(73) Assignee: Olimex Group, Inc., Lawrenceville, NJ (US)

( * ) Notice: Subject to any disclaimer, the term of this patent is extended or adjusted under 35 U.S.C. 154(b) by 0 days.

(21) Appl. No.: 10/395,855

(22) Filed: Mar. 25, 2003

(51) Int. Cl.[7] ..... C25D 11/02

(52) U.S. Cl. ..... 205/107; 204/230.2; 204/230.6; 205/82; 205/83; 205/318; 205/319; 205/322; 205/326; 205/333

(58) Field of Search ..... 205/82, 83, 107, 205/318, 319, 322, 326, 333; 204/230.2, 230.6

(56) References Cited

U.S. PATENT DOCUMENTS

| | | | | |
|---|---|---|---|---|
| 3,293,158 | A | 12/1966 | McNeill et al. | |
| 3,708,407 | A | 1/1973 | Newman et al. | |
| 3,812,021 | A | 5/1974 | Craig, Jr. et al. | |
| 3,857,766 | A | 12/1974 | Woods | |
| 3,956,080 | A | 5/1976 | Hradcovsky et al. | |
| 3,983,014 | A | 9/1976 | Newman et al. | |
| 4,030,998 | A * | 6/1977 | Barrault | 204/219 |
| 4,082,626 | A | 4/1978 | Hradcovsky | |
| 4,659,440 | A | 4/1987 | Hradcovsky | |
| 4,879,018 | A | 11/1989 | Fenoglio et al. | |
| 5,069,763 | A | 12/1991 | Hradcovsky | |
| 5,147,515 | A | 9/1992 | Hanagata et al. | |
| 5,275,713 | A | 1/1994 | Hradcovsky | |
| 5,385,662 | A | 1/1995 | Kurze et al. | |
| 5,616,229 | A | 4/1997 | Samsonov et al. | |
| 5,620,582 | A * | 4/1997 | Lerner | 205/107 |
| 6,113,770 | A | 9/2000 | Rasmussen | |
| 6,168,869 | B1 | 1/2001 | Tomioka et al. | |
| 6,181,116 | B1 * | 1/2001 | Jansen | 323/261 |
| 6,197,178 | B1 | 3/2001 | Patel et al. | |
| 6,238,540 | B1 | 5/2001 | Timoshenko et al. | |
| 6,264,817 | B1 | 7/2001 | Timoshenko et al. | |
| 6,358,616 | B1 | 3/2002 | Jennings | |
| 6,365,028 | B1 | 4/2002 | Shatrov | |
| 6,716,333 | B2 | 4/2004 | Pearsall et al. | |
| 2001/0019778 | A1 | 9/2001 | Gardaz et al. | |
| 2002/0012962 | A1 | 1/2002 | Stahl | |

FOREIGN PATENT DOCUMENTS

| | | | |
|---|---|---|---|
| DE | 4209733 | A1 | 9/1993 |
| EP | 1050606 | A1 | 11/2000 |
| EP | 1050606 | B1 | 4/2003 |
| JP | 11-137440 | | 5/1999 |
| RU | 2070622 | C1 | 12/1996 |
| WO | PCT WO 95/18250 | | 7/1995 |
| WO | PCT WO 98/38603 | | 12/1996 |
| WO | PCT W 97/03231 | | 1/1997 |

* cited by examiner

*Primary Examiner*—Roy King
*Assistant Examiner*—William T. Leader
(74) *Attorney, Agent, or Firm*—McDermott Will & Emery LLP

(57) ABSTRACT

A ceramic coating is formed on a conductive article by immersing a first anodic electrode, including the conductive article, in an electrolyte comprising an aqueous solution of alkali metal hydroxide and an alkali metal silicate, providing a second cathodic electrode in contact with the electrolyte, and passing an alternating current from a resonant power source through the first electrode and to the second electrode while maintaining the angle ϕ between the current and the voltage at zero degree, while maintaining the voltage within a predetermined range. The resulting ceramic coated article comprises a coating which includes a metal, silicon, and oxygen, wherein the silicon concentration increases in the direction from the article surface toward an outer surface of the ceramic coating surface layer.

10 Claims, 24 Drawing Sheets

METHOD OF MAKING A COMPOSITE ARTICLE COMPRISING A CERAMIC COATING

FIELD OF THE INVENTION

The present invention relates to composite articles and, more particularly, to composite articles comprising a metal with a ceramic coating on at least one surface thereof. The present invention also relates to a process of ceramic coating of metals and their alloys.

BACKGROUND OF THE INVENTION

Coated articles find application in many varied environments including, but not limited to, aerospace, automotive, marine, oil, gas and chemical engineering, electronics, medicine, robotics, textile and other industries. A useful but non-limiting application of coated articles is for coated valve metals (e.g., barrier layer-forming metals or rectifier metals) and their alloys, such as aluminum, magnesium, titanium and alloys thereof, which are widely used in different industries. To improve the valve, valve component, or valve surface wear resistance, chemical resistance and dielectric strength, for example, a protective coating possessing the necessary properties for a desired application may be formed on a respective surface or surfaces thereof. Various conventional anodizing processes can provide some of these protective properties. In a typical aluminum anodizing process, an aluminum article is placed in a bath containing an electrolyte, such as sulfuric acid, and an electric current is passed through the aluminum article (i.e., anode). Due to electrolytic oxidation, a protective aluminum oxide layer forms on the surface of the aluminum article. The resulting finish is extremely hard and durable, and exhibits a porous structure which allows secondary infusions, such as lubricity aids.

Conventional anodizing processes include, for example, U.S. Pat. Nos. 3,956,080, 4,082,626, and 4,659,440 which disclose methods of coating aluminum and other valve metals and their alloys by an anode spark discharge technique using direct current with voltages up to 450 V and current densities 2–20 A/dm$^2$, usually around 5 A/dm$^2$. The properties of the ceramic coatings are dependent on the composition of the electrolytic solutions, as well as on other process conditions, such as temperature, current voltage and density. Generally, it is possible to form ceramic coatings with good corrosion and chemical resistance; however, their mechanical properties, such as hardness, durability, and adherence to the substrate, are not entirely satisfactory. Moreover, the coating rate is relatively slow and, thus, productivity is limited.

In other conventional processes, such as described in U.S. Pat. Nos. 5,147,515 and 5,385,662, high voltage direct current of different waveforms is used, with voltages of about 1,000 V and even up to 2,000 V. These ceramic coatings have much better mechanical properties, such as hardness. However, their thicknesses are limited to about 80 $\mu$m and 150 $\mu$m, respectively. The rate of coating deposition is also relatively slow, at best reaching 1.75 $\mu$m/min, usually around 1 $\mu$m/min. The necessity of using high voltages and current densities (between 5–20 A/dm$^2$) makes the process very energy consuming and, thus, expensive. In addition, the process described by Kurze et al. (U.S. Pat. No. 5,385,662) requires bath temperatures in the range of −10° to +15° C. and only allows for a very narrow temperature fluctuation range of ±2° C. It is also not clear how the different shapes of current affect the coating properties.

In U.S. Pat. Nos. 5,616,229 and 6,365,028, a high voltage (at least 700 V) alternating current is used instead of direct current. The thus-formed ceramic coatings have very good mechanical properties, with hardness exceeding 2,000 HV and adhesion to the substrate up to 380 MPa. The coating deposition rate is in the range 1–2.5 $\mu$m/min, which also compares favorably with previous methods. The method described in U.S. Pat. No. 5,616,229 uses a high voltage alternating current power source with a special, modified wave form, obtained by using a capacitor bank connected in series between the high voltage source and metal which is being coated. Although the disclosed method enables the formation of relatively thick coatings at a high rate of deposition, it is not clear how the current wave form is preserved and controlled during the process of ceramic deposition and how a possible departure from that wave form influences the process. Moreover, the proposed apparatus has a complex design due to the use of several baths containing different electrolyte solutions in which components are being coated in sequence. Power demands are still very high in both methods (the method described in U.S. Pat. No. 6,365,028 requires in its initial stage a current density of 160–180 A/dm$^2$), and it is not clear if components of low thickness, e.g. 50 $\mu$m or less, and components of complex shapes with uneven residual (locked-up) stresses or of large surface sizes can be coated. U.S. Publication Application No. 20020112962 A1, published Aug. 22, 2002, is generally similar to the aforementioned patents and teaches optimization of current and voltage during various stages of coating.

All the aforementioned patents and described therein methods of forming ceramic coatings differ from one another in either the type of current used (DC or pulse DC or AC), voltage and current density values, or specific current wave forms and generally assign a significant role to the composition of electrolyte solutions. However, specific electrolytes are often very similar and vary with respect to only a pair of ingredients.

Accordingly, there is a need for an improved process for forming a ceramic coating on an article that addresses the disadvantages present in the known processes and for composite articles comprising an improved ceramic coating.

SUMMARY OF THE INVENTION

In accord with aspects of the invention, ceramic coatings having improved properties heretofore not attainable by anodic spark discharge are formed on metallic substrates (e.g., Al and Al-based alloys) by a novel electrochemical anodization process wherein the electrochemical anodization cell, comprised of the substrate as anode and a cathodic electrode, form part of an LC oscillator circuit in conjunction with a power supply and a variable inductance. In combination, these elements form a resonant power supply, as described herein, which establishes and maintains the angle between the current and the voltage at zero degrees ($\cos \phi=1$), thus establishing resonance during the coating process.

The process of the invention deposits ceramic coatings on a wide range of components of different shapes, sizes, thickness, and materials (e.g., metals and metal alloys such as, but not limited to, aluminum, titanium, magnesium, nickel, cobalt, zirconium, halfnium, and alloys thereof) in accord with an intended use or application thereof. Applications of such coated articles include, but are not limited to, valves, valve components, non-magnetic substrates for magnetic recording, piping, pumps, transformers, engine components such as turbine blades, semiconductor manufacturing, engine housings, cookware, food processing equipment, chemical handling equipment, jet fuel tanks, magnetic pumps, missiles, medical implants, and even structural components for military aircraft utilizing radar absorptive materials to minimize radar cross-section. The inventive process can be used to coat components of very low thickness (even less than 50 $\mu$m) and of complex shapes, preserving both the quality of the substrate material and of the coating. The maximum surface of the coated components is practically limited only by the size of the electrolytic bath.

An object of the present invention is to provide methodology enabling the formation of ceramic coatings exhibiting superior physical/mechanical and protective properties, such as very high hardness, increased tensile strength, wear and heat resistance, extremely strong adherence to the substrate, low friction coefficient, high dielectric strength, and very high chemical and corrosion resistance.

Another object of the present invention is to increase the rate of coating-deposition while at the same time decreasing the energy consumption during the process, compared to the similar ceramic coating processes of the prior art, and to provide coatings with thickness up to 300 $\mu$m and more.

Still another object of the present invention is to provide a process, which uses environmentally friendly, inexpensive components for the electrolyte solution.

Accordingly, a method is provided herein for forming a ceramic coating on an electrically conductive article, the method comprising immersing a first electrode comprising the electrically conductive article in an electrolyte comprising an aqueous solution of alkali metal hydroxide and a metal silicate (e.g., such as an alkali silicate, which may include but is not limited to a sodium silicate or potassium silicate), providing as a second electrode the vessel containing the electrolyte or an electrode immersed in the electrolyte, and passing an alternating current from a resonant power source through the first electrode and the second electrode while maintaining the angle $\phi$ between the current and the voltage at zero degree and the voltage within a predetermined range.

Also provided herein is an aluminum article bearing a ceramic coating on a surface thereof, the ceramic coating comprising aluminum, silicon, and oxygen, and substantially separate regions of aluminum oxides and silicon oxides within the surface layer and the sub-layer, wherein a silicon concentration increases in the direction from surface of the article toward an outer surface of the ceramic coating surface layer.

In another aspect, there is provided an article bearing a ceramic coating on a surface thereof, the ceramic coating comprising a metal, silicon, and oxygen, wherein a silicon concentration increases in the direction from the article surface toward an outer surface of the ceramic coating surface layer.

Various objects and features of the present invention will become more readily apparent to those skilled in the art from the following description of a specific embodiment thereof, especially when taken in conjunction with the accompanying drawings.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

Figure 1:
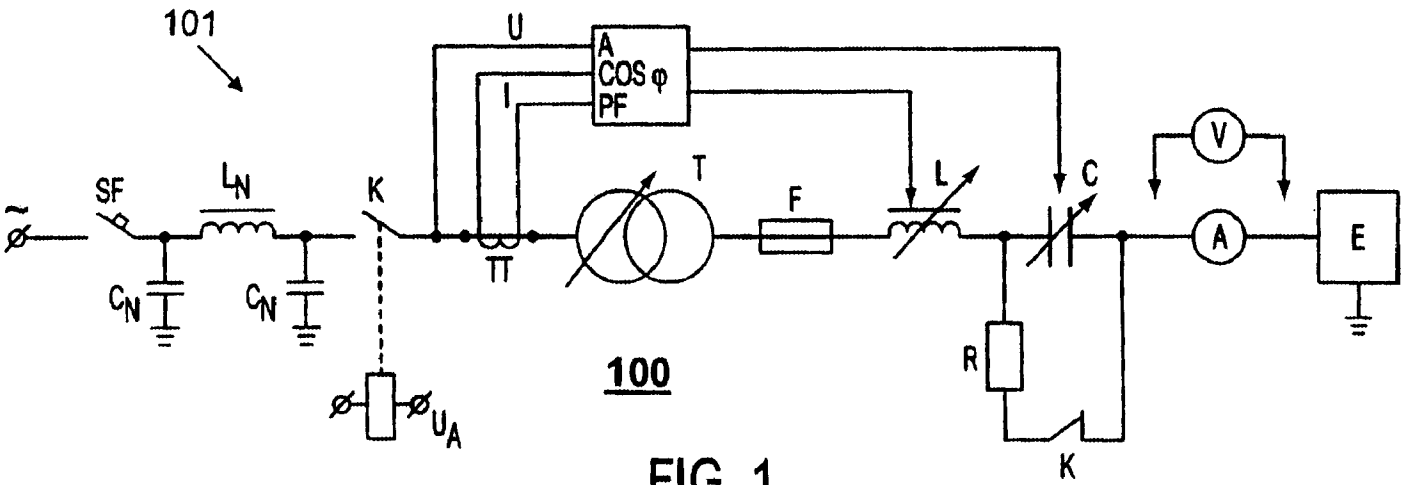
FIG. 1 illustrates a resonant power supply.

The figures referred to herein are presented for clarity of illustration and are not necessarily drawn to scale and are not necessarily inclusive of every feature or aspect of the invention disclosed herein. Elements having the same reference numerals refer to elements having similar structure and function.

DETAILED DESCRIPTION OF THE INVENTION

In the following description, for the purposes of explanation, numerous specific details are set forth in order to provide a thorough understanding of the present invention. It will be apparent, however, to one skilled in the art that the present invention may be practiced without these specific details. In other instances, well-known structures and entities are shown in schematic form in order to avoid unnecessarily obscuring the present invention.

The present invention provides methodology for forming a ceramic coating on an article, such as, but not limited to, valve components formed from a metal (e.g., metal, metals, or alloy), in an alkaline electrolyte at a temperature of between about 15–40° C. The process includes immersing the article as an electrode in an electrolytic bath, comprising an aqueous solution of an alkali metal hydroxide and a metal silicate (e.g., such as an alkali silicate, which may include but is not limited to a sodium silicate or potassium silicate). A second electrode may be provided and may comprise either the vessel containing the electrolyte or a conventional electrode, such as a stainless steel electrode, immersed in the electrolyte. The method utilizes a special resonant power supply, disclosed in co-pending U.S. patent application Ser. No. 10/123,517, titled "Universal Variable-Frequency Resonant Power Supply" filed on Apr. 17, 2002, the entire disclosure of which is hereby incorporated by reference herein. The alternating current from this resonant power supply is passed through a surface of the article or component and the second electrode. The resonant power supply permits maintenance of a resonance condition and a power factor coefficient equal to one.

Under this condition, the dynamics of the process are changed, e.g., the spectrum of component frequencies is widened from 1–2 kHz to 10 kHz. The formation of such a wide spectrum of component frequencies appears to promote even spreading of micro-arc discharges on the surface and preserves materials with very low thickness from perforation and burning out of the edges. The availability of that spectrum provides the synchronization of the separate stages of the process, such as the appearance of a barrier layer (passive condition), the formation of a thin dielectric ceramic film and its dielectric breakdown, as well as the formation and size of micro-arcs, heating, melting, which influence the formation of the coating structure.

The optimum deposition conditions can be determined in a particular situation depending upon, inter alia, the technical requirements. For example, a coating deposition possessing a high dielectric strength and corrosion resistance with good mechanical properties can be obtained using an electrolyte containing an alkali metal hydroxide and a metal silicate (e.g., such as an alkali silicate, which may include but is not limited to a sodium silicate or potassium silicate). In most cases these coating attributes are met by a coating thickness of about 50 microns.

For applications in which the coating should desirably exhibit special mechanical properties, such as a very high hardness and increased wear resistance, a metal or mixed complexes of metals may be introduced into the electrolyte. Such metal or mixed complexes of metals allow formation of a coating with such desired properties having a thickness of greater than about 300 microns. Since most metals form complex compounds with polyphosphates (n=3–10) and with amines (monoethanolamine, triethanolamine, etc.) as well, it is preferred to select metals from the group comprising Cu, Zn, Cd, Cr, Fe, Ti, Co, and the like. For example, introduction of mixed complexes such as $Cu^{+2}$—$P_3O_{10}^{5-}$-triethanolamine or $Zn^{2+}$—$P_3O_{10}^{5-}$-monoethanolamine-$NH_4H_2PO_4$, leads to the changing of coating properties received from the basic electrolyte due to inclusion of metals (Cu, Zn) and phosphates. In such a case, the conductivity of both the electrolyte and the deposited coating is being increased which permits a high current density to be maintained for an increased duration during the coating process. This, in turn, significantly increases the rate of deposition and the coating thickness. The complex compounds are stable in the electrolyte but are decomposed under high temperatures (i.e. during surface micro-arc discharge). Including metals and phosphates in the coating permits alteration of the coating properties in a manner known to those skilled in the art. Not only is use of mixed complexes ecologically appropriate, but the materials used are also inexpensive and readily available.

The aforementioned resonant power supply itself advantageously decreases the time before the micro-arcs appear, increases the deposition rate up to about 1.5–2 times relative to conventional methods, and improves the quality of coating by keeping cos $\phi$=1 during the deposition process.

FIG. 1 depicts a simplified diagram of a power supply 100, having a resonant circuit 101 electrically connected thereto (collectively a resonant power supply), for the deposition of ceramic coatings by micro-arc oxidization, such as described in more detail in co-pending U.S. patent application Ser. No. 10/123,517, noted above and incorporated by reference herein in its entirety. The resonant power supply provides power to a load, namely an electrolytic bath, for performing micro-arc oxidation. The resonant circuit 101 comprises at least one adjustable element for tuning the circuitry to resonance during a coating operation. As understood to those skilled in the art, the circuitry may be configured to provide resonance at any selected frequency.

In one aspect, the resonant power supply circuitry 101 may comprise an automatic circuit-breaker SF, connecting the resonant circuit 101 to the main power supply 100 and also serving as an overload and short-circuit protection. A LC low-pass filter block, consisting of inductance $L_n$ and capacitance $C_n$, lowers the level of current and higher voltage harmonics and substantially, if not entirely, eliminates noise. Master reed relay K serves as an operational on/off switch of the power supply 100 both in a manual and an automatic regimen of a coating process. Isolation transformer T implements galvanic isolation of the bath E and is configured to permit changing of the current parameters and voltage on the load. An additional inductance L, together with the reduced inductance of the secondary windings of the transformer T and capacitance C, is connected in series with bath E. According to this configuration, the current and voltage on the load and also their rate of change depend on the parameters of the resonant circuit and are optimal within the resonant zone. Further, an automatic regulator A is provided to maintain optimal parameters L and C in the resonant circuit 101 by independently determining active and reactive current components through measurement of the current and the voltage, thereby maintaining a high power factor coefficient (cos $\phi$=1) of the power supply along throughout the coating process.

Regulation of the current on the bath E may be implemented in various manners including, but not limited to, changing transformation co-efficiency of the transformer T, changing the total value of the capacitance C and the inductance L, coupling with the bath E semiconductor current regulators or a block of high power rating resistors and switching their total resistance value, or controlling the surface of a component that is being coated in the bath (e.g. using a jigging device).

Figure 2:
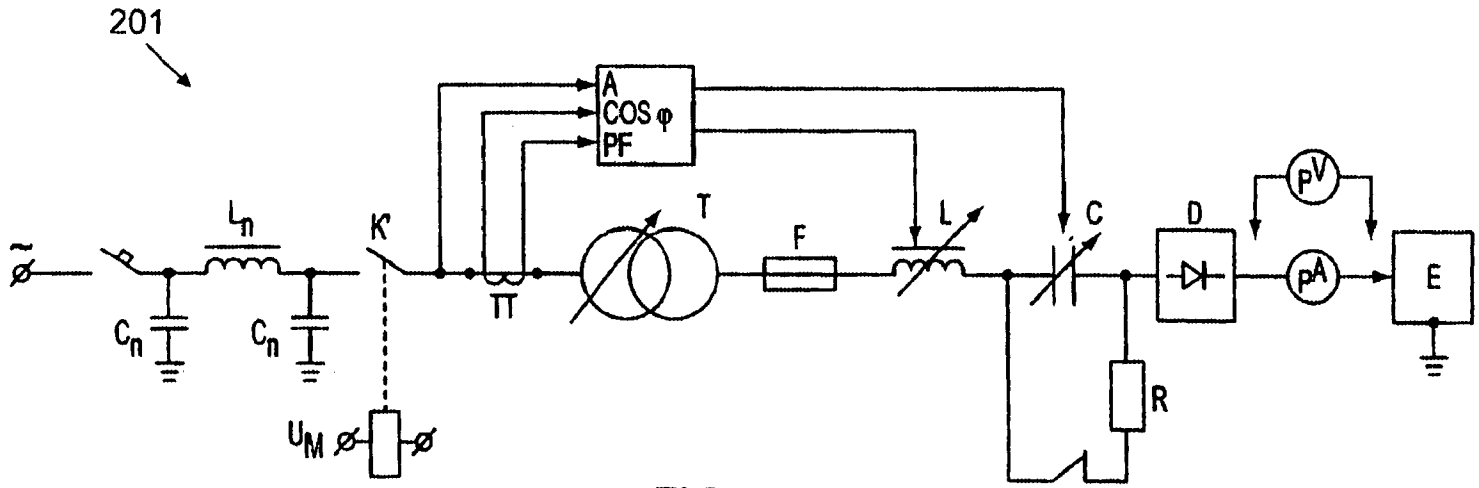
FIG. 2 illustrates another aspect of a resonant power supply.
Figure 3:
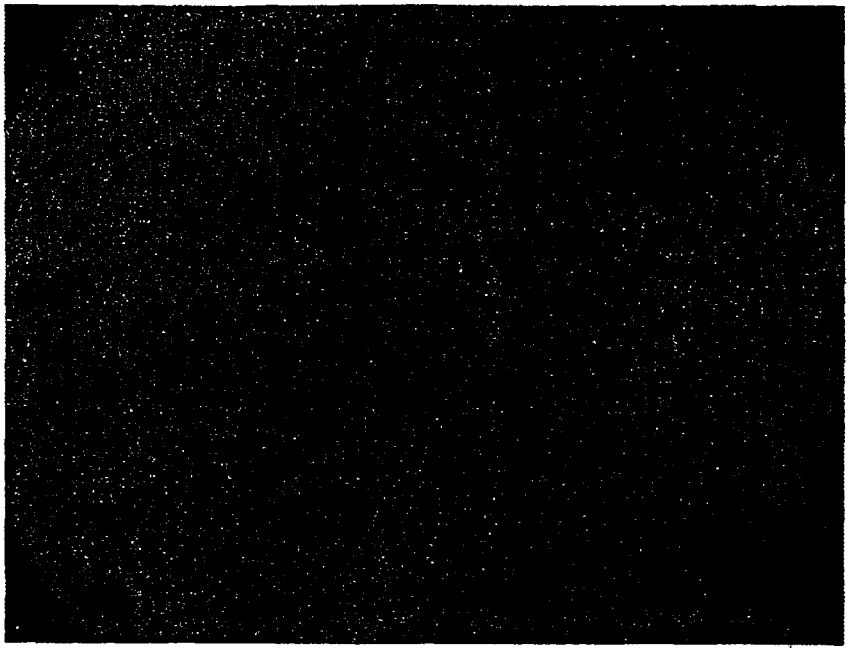
FIGS. 3–6 show spectrum analyzer pictures of alternating components in the resonant circuit of FIG. 1 under various conditions.
Figure 4:
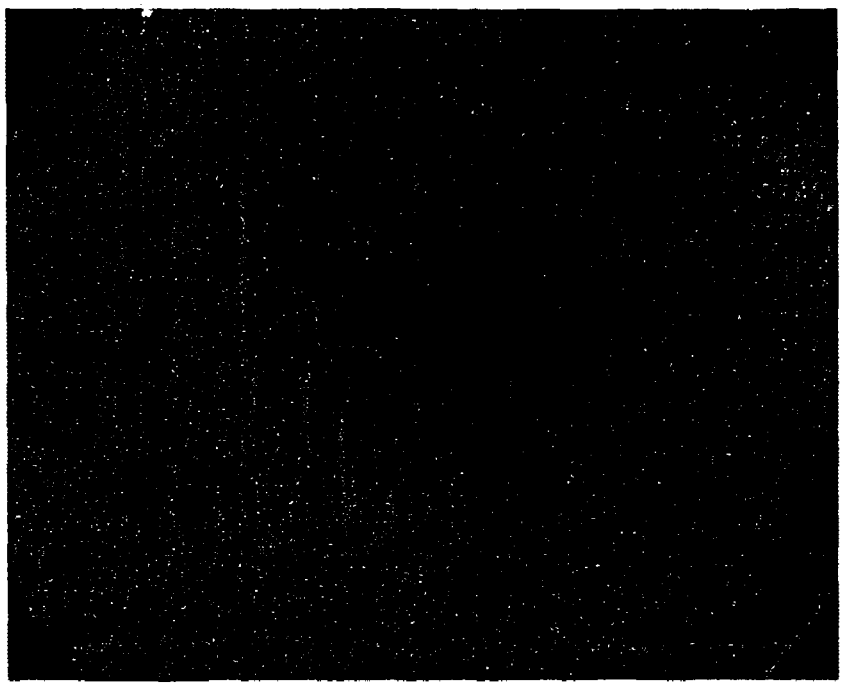
Figure 5:
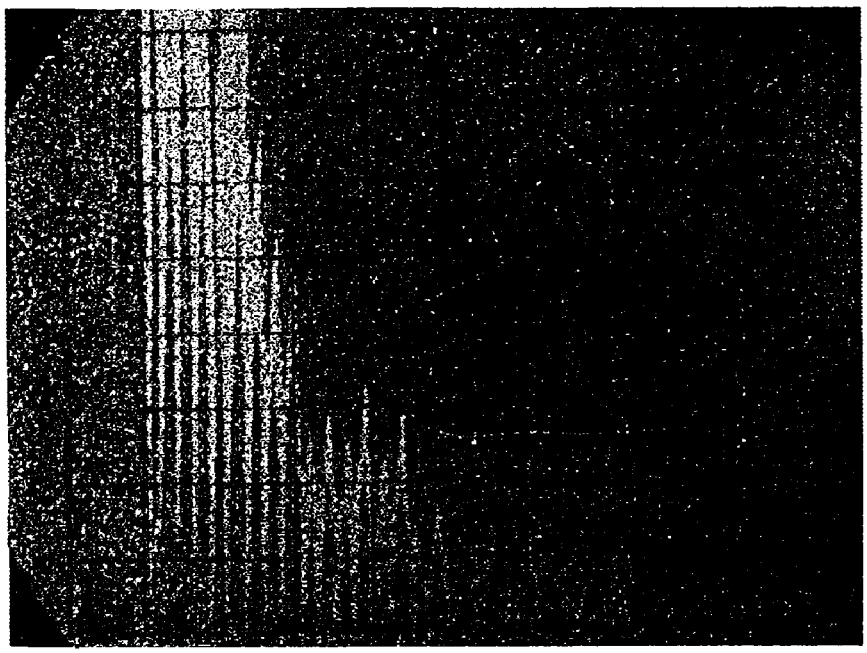
Figure 6:
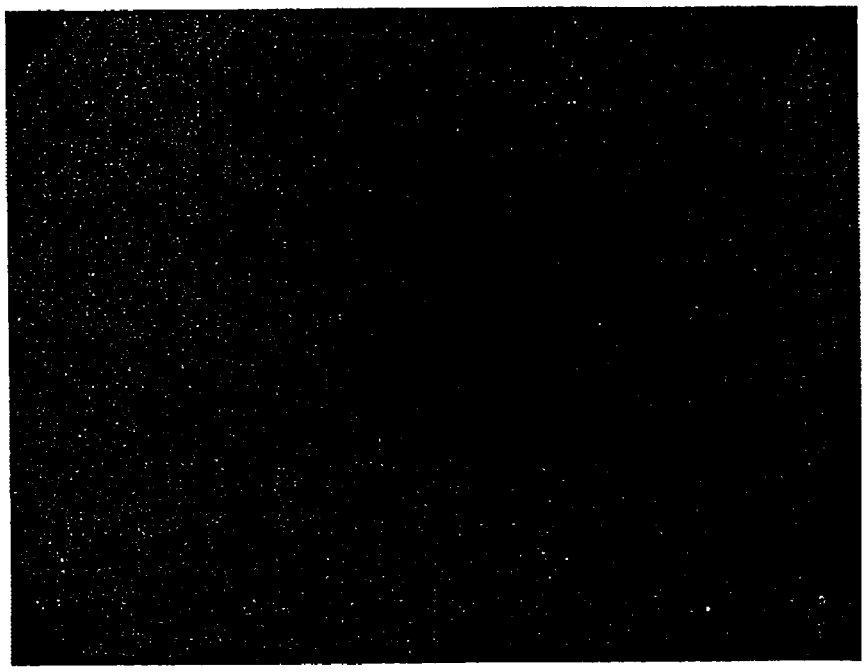

A very similar diagram can be drawn for the circuit for conducting deposition of ceramic coatings by micro-arc oxidization under DC or pulse current. As shown in FIG. 2, such resonant circuit 201 additionally includes a rectifier block D connected into the circuit of bath E, which rectifies the AC current and provides direct availability of the positive potential on the components that are being coated and of the negative potential on the electrolyte in bath E.

FIGS. 3–6 respectively show spectrum analyzer pictures of alternating components in the resonant circuit, taken under the following conditions: current on the load I=24A, voltage on the load U=310V, electrolyte containing NaOH 1 g/liter and $Na_2SiO_3$ 5 g/liter. The horizontal scale unit on each picture is 0.2 kHz, except for FIG. 6, where it is 0.5 kHz. As seen in FIGS. 3–6, raising the power factor (cos $\phi$=0.65, 0.75 and 0.992 in FIGS. 3–5, respectively) allows for widening of the spectrum of alternating components up to around 10 kHz at power factor (cos $\phi$)=1.

Figure 7:
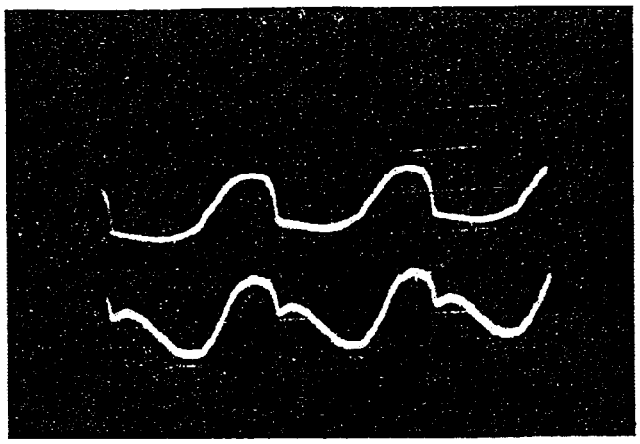
FIGS. 7–9 show pictures taken from an oscilloscope representing different current waveforms in the circuit of FIG. 1 under various conditions.
Figure 8:
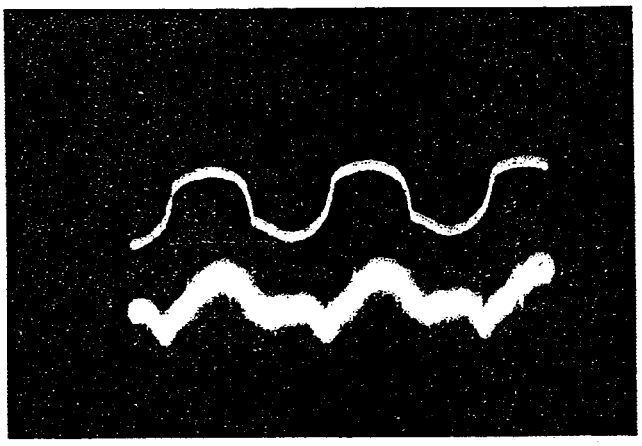
Figure 9:
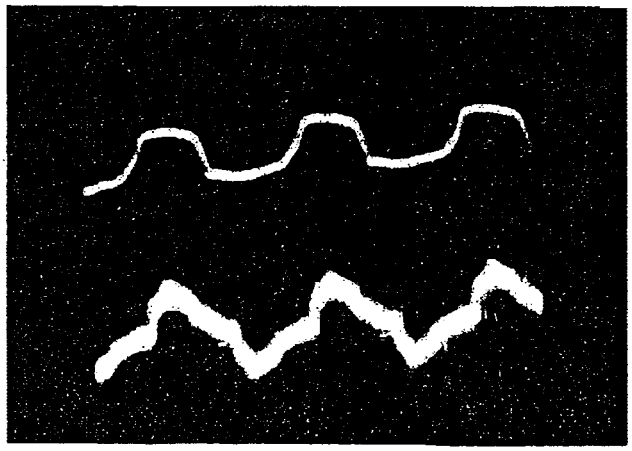

FIGS. 7–9 show oscilloscope pictures representing different current waveforms in the same circuit (U=310V, I=25A), depending on different values of cos $\phi$ including cos $\phi$=0.75, cos $\phi$=0.992, and cos $\phi$~1, respectively.

The resonant circuit (e.g., 101) supports a micro-arc oxidation process carried out in electrolytic bath E. For example, the power supply 100 and associated resonant circuit 101 supports a micro-arc oxidation process for producing an article comprising a metal with a ceramic coating on at least one surface thereof, typically a composite comprising a metal or metal alloy layer with an upper surface and a lower surface and a ceramic coating on the upper and lower surfaces. The ceramic coating is formed by electrochemical deposition in an electrolytic bath on metals selected from the group including, but not limited to, Al, Ti, Mg, Zr, V, W, Zn and their alloys.

During micro-arc oxidation, a metal article is subject to a high electrical current density while submerged as an anode in the electrolytic bath E, which contains an electrolytic solution. Due to electrochemical anodization reaction between the metal and the electrolytic solution, an anodic oxide coating is formed on the surface of the metal. In one embodiment of the invention, during the electrochemical deposition of the oxide coating, anodic electrical current flows from resonant circuit 101, through an electrode (anode) to which the component or article to be coated is attached, through the electrolyte of the electrolytic bath E, and through a cathodic element, such as a stainless steel electrode, which may be connected to ground, as shown in FIG. 1. In accord with the invention, during the electrochemical deposition, the circuit including the electrolytic bath E and the resonant circuit 101 is tuned to resonance. In the resonance condition (cos $\phi$=1) the widest spectrum of component frequencies (up to 10 kHz) in the bath circuit can be obtained. Resonance may be determined using a measuring instrument, such as an ammeter, or a voltmeter.

For example, the value of capacitor C included in resonant circuit 101 may be selected to tune the circuit comprising bath E to resonance. As depicted in FIG. 1, inductor L and capacitor C of the resonant circuit 101 are connected in series and are configured to deliver a resonant voltage several times greater than the input voltage of resonant circuit 101. In a resonant circuit including the electrolytic bath E, a change in the electrochemical deposition condition or electrical parameters of the coating during the micro-arc oxidation requires the elements of the resonant circuit 101 to be adjusted to maintain the resonance of the circuit including electrolytic bath E and the resonant circuit 101 of power supply 100. Hence, resonant circuit 101 is adjustable in accord with a deposition condition.

Also, parameters of the resonant circuit 101 may be varied during the electrochemical deposition to synchronize different phases of the micro-arc oxidation process in order to obtain desired properties of the coatings such as, but not limited to, micro-hardness, thickness, porosity, adhesion to substrate, coefficient of friction, and electrical and corrosion resistance. The resonance maintained during the micro-arc oxidation process in accord with the invention makes it possible to produce coatings having high hardness, good adhesion to substrate, high electrical and good corrosion resistance.

During the electrochemical deposition in the electrolytic bath E, the parameters of the resonant circuit 101 may be adjusted to maintain the power factor of the power supply 100 at a level close to 1. As a result, the efficiency of the power supply 100 and the efficiency of the electrochemical deposition improve, and the micro-hardness of the coating increases.

When using micro-arc oxidization technology at voltages of about 206V or greater, micro-arcs penetrate the boundary between the electrolyte solution and the oxide and between the oxide and the substrate. In effect, a multitude of electric breakdowns of the film occur, causing an increase of temperature in breakdown channels and surrounding areas. As a result, the thickness of the coating increases. Inside the breakdown channels, low temperature plasma is formed. In this plasma, reactions take place which include components of the electrolyte solution into the formed oxide. At the same time, the already deposited coating is being melted around plasma craters. Thus, the consequence of breakdowns is an increase in the rate of oxide formation and a change in chemical and physical properties of the received coating. Therefore, crystalline inclusions and high temperature modifications of oxides are formed in place of amorphous oxides. A result of this process is a thin, tough, and durable coating which has properties (chemical, phase compositions and mechanical) very similar to ordinary ceramic (i.e., high adhesion to substrate combined with hardness, high temperature, high voltage, and corrosion resistance).

The above properties can be influenced by changing electrolysis conditions, the composition of the electrolyte solution, and the form of current. Micro-arcing on the anode (which typically includes the article or component on which the ceramic is to be formed) is possible if the surface of the electrode/article is coated with a dielectric film. A thin, barrier-type oxide film, which is formed in the initial stage of the anode-arc electrolysis, possesses such properties. The higher the dielectric quality of the film, the higher the voltage required for the electro-deposition process, which leads to the increase in dielectric and tensile strength properties of the resulting coating. The nature of the initial oxide film is linked to the character of the chemical interaction between the metal and the electrolyte. Thus, in the process of micro-arc coating, the following stages can be formulated (distinguished): appearance (forming, creating) of the passive condition, formation of a thin dielectric film, and breakdown of the film and resulting micro-arcs which create necessary conditions for the formation of non-organic coating. During the breakdown, together with a sharp increase in ion migration, the electron part of the current is also significantly increased, which plays the main role in the initial phase of the breakdown.

Although the electrochemical process can be controlled by changing current and voltage, during its initial stage the necessary current is directly proportional to the surface size of the component to be coated (about 20A/dm2), and the necessary voltage is established in dependence of the dielectric properties of the resulting film. Taking into consideration the fact that the parameters of the process change in time, in the present case it is necessary to provide a high power factor value of nearly 1, ensuring the forming of the alternating components of spectrum of 10,000 Hz, which exerts great influence on the quality of the coating (the highest hardness) and maximal productivity of the process. The amplitude of the alternating components formed during the process depend on the coating conditions. The composition of the electrolytic solution can be changed in a wide range, depending on the required qualities of the coating. In the case of aluminum and its alloys, a solution consisting of NaOH 1–5 g/liter and $Na_2SiO_3$ 1–500 g/liter can be used.

The temperature of the electrolyte should be maintained in range of 15–40 degrees centigrade. The cathode is usually made of stainless steel. The duration of the process depends on the required thickness of the coating (in a majority cases up to 2 hours). As a rule, after coating no special treatment is necessary (for example, thermal, etc.)

Specimen articles comprising aluminum substrates possessing an electrolytically deposited ceramic coating formed thereon in accord with the above-described process were prepared and analyzed. Scanning Electron Microscopy (SEM), Energy Dispersive Spectroscopy (EDS), Digital X-ray dot mapping, X-ray Diffraction (XRD), micro-hardness, corrosion, and 4-point probe electrical measurements were performed to ascertain properties of the ceramic coating. The specimen ceramic coating thicknesses ranged from about 2–3 $\mu$m to about 60 $\mu$m. The majority of these experiments were performed on a specimen bearing a ceramic coating having a thickness between about 40 to 60 $\mu$m, so as to negate the effects of the aluminum substrate and facilitate experimental analysis. Corrosion testing was performed on another sample having a ceramic coating thickness ranging from about 10–12 $\mu$m.

Figure 10:
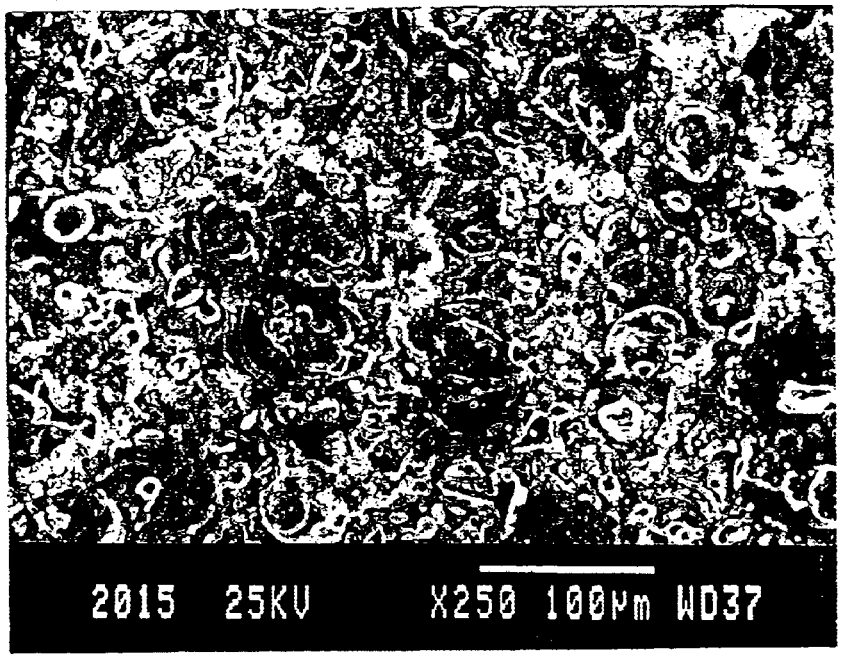
FIGS. 10–12 show scanning electron micrographs of the ceramic coating surface.
Figure 11:
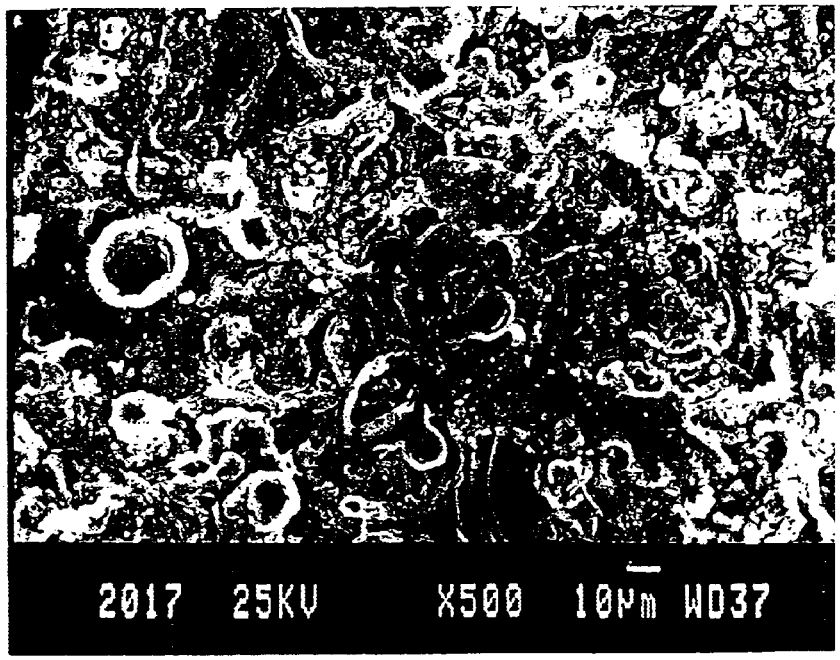
Figure 12:
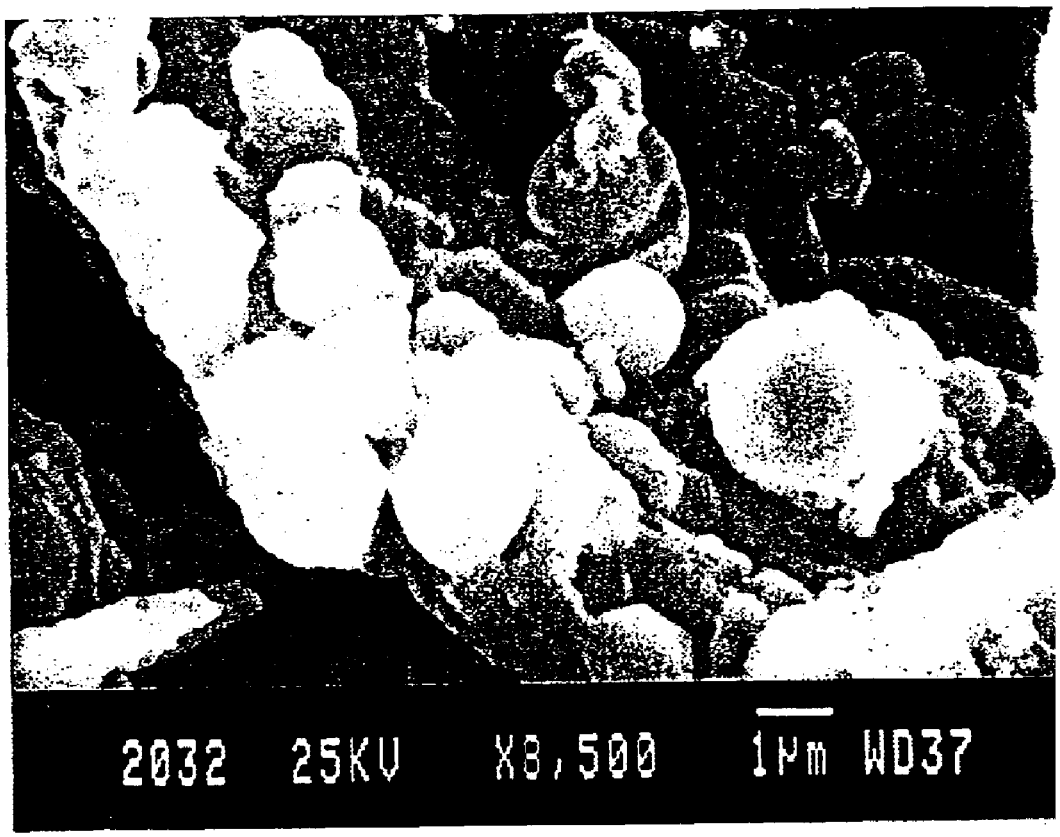

FIGS. 10–12 show scanning electron micrographs of the ceramic coating surface taken at a variety of magnifications (×250, ×500, and ×8500, respectively). They reveal that the ceramic film's surface has a somewhat mottled and porous appearance, the pores ranging in size anywhere from tenths to tens of microns. There is a combination of both smooth and faceted structures mixed together throughout the surface.

Figure 13:
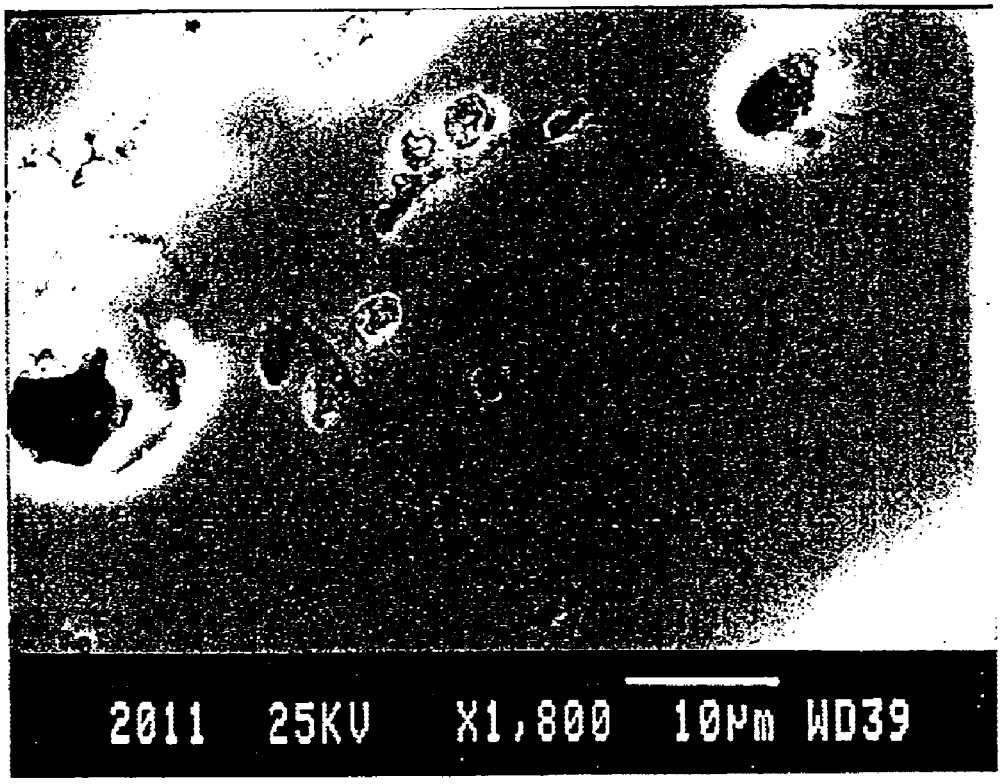
FIGS. 13–15 show polished cross-sections of the ceramic coating.
Figure 14:
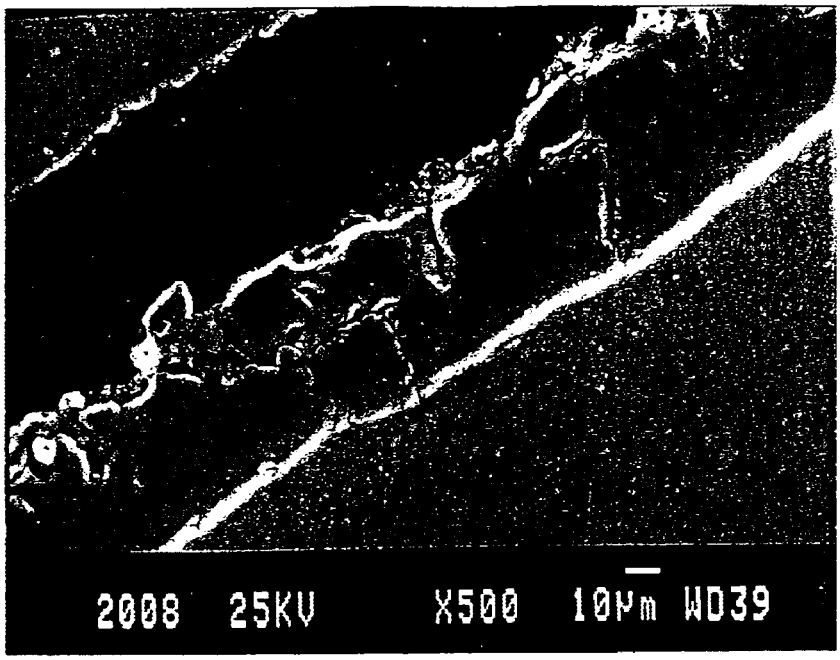
Figure 15:
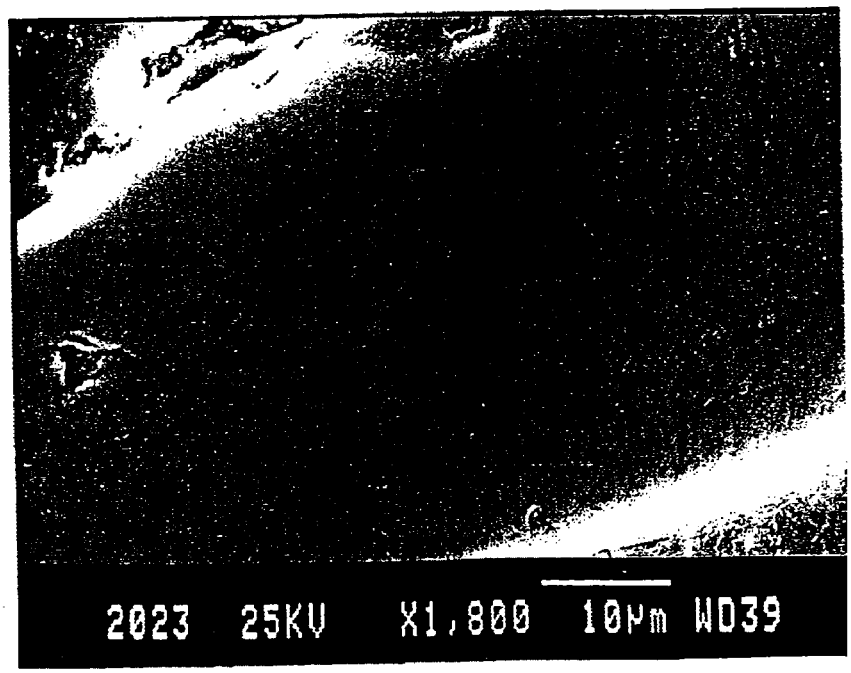

Polished cross-sections of the ceramic coating are shown in FIGS. 13–15, which display pores within the coating, in some cases connecting from surface to substrate. These scanning electron micrographs of the ceramic coating cross-sections were taken at a variety of magnifications (×1800, ×500, and ×1800, respectively). The transition zone between the metal and the coating is less than about 0.1 $\mu$m thick. Some granularity is visible in the sub-micron to micron range, suggesting at least partial crystallinity.

Figure 16:
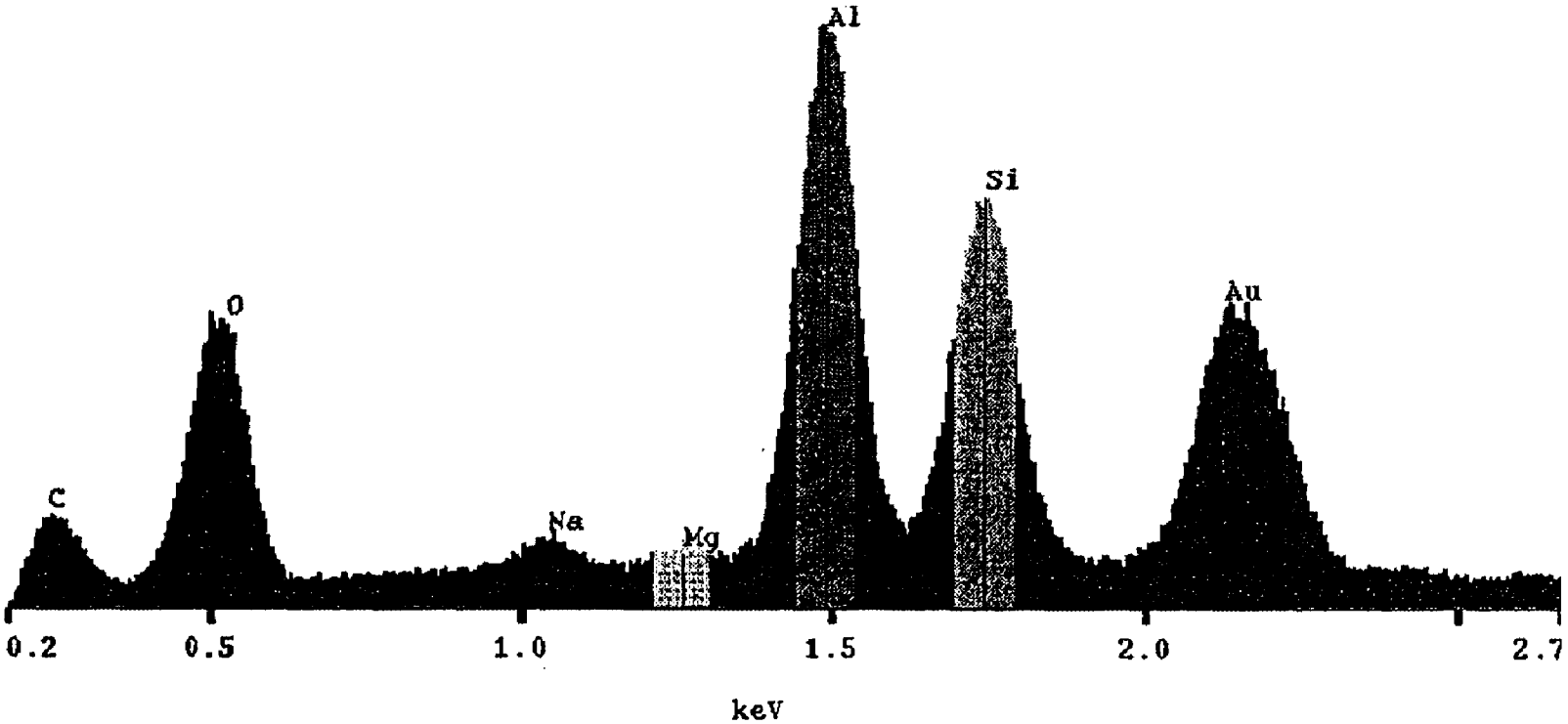
FIG. 16 illustrates an energy dispersive x-ray spectra taken at an acceleration voltage of 10 kV of one region of the ceramic coating.
Figure 17:
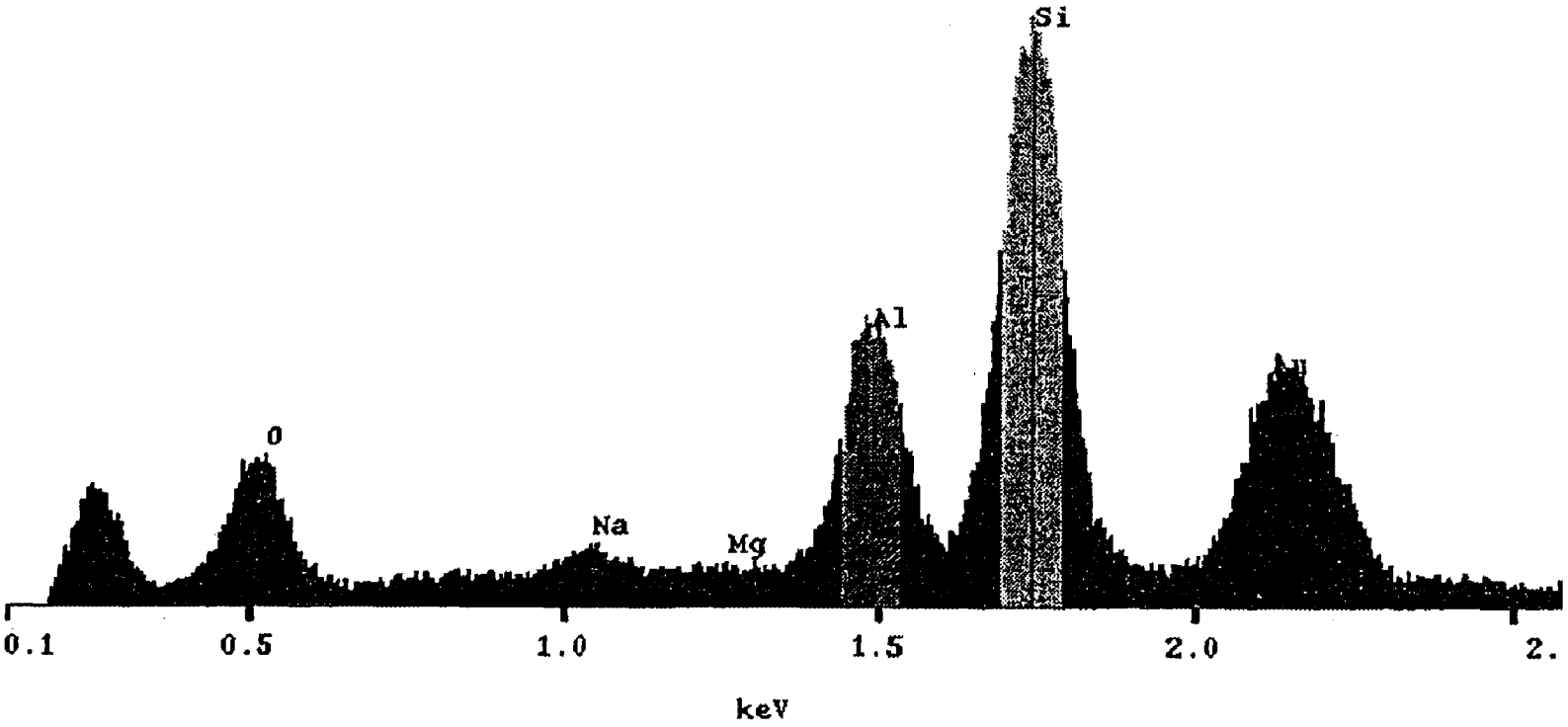
FIGS. 17–18 illustrate energy dispersive x-ray spectra taken at an acceleration voltage of 10 kV of regions of the ceramic coating different than that shown in FIG. 16.
Figure 18:
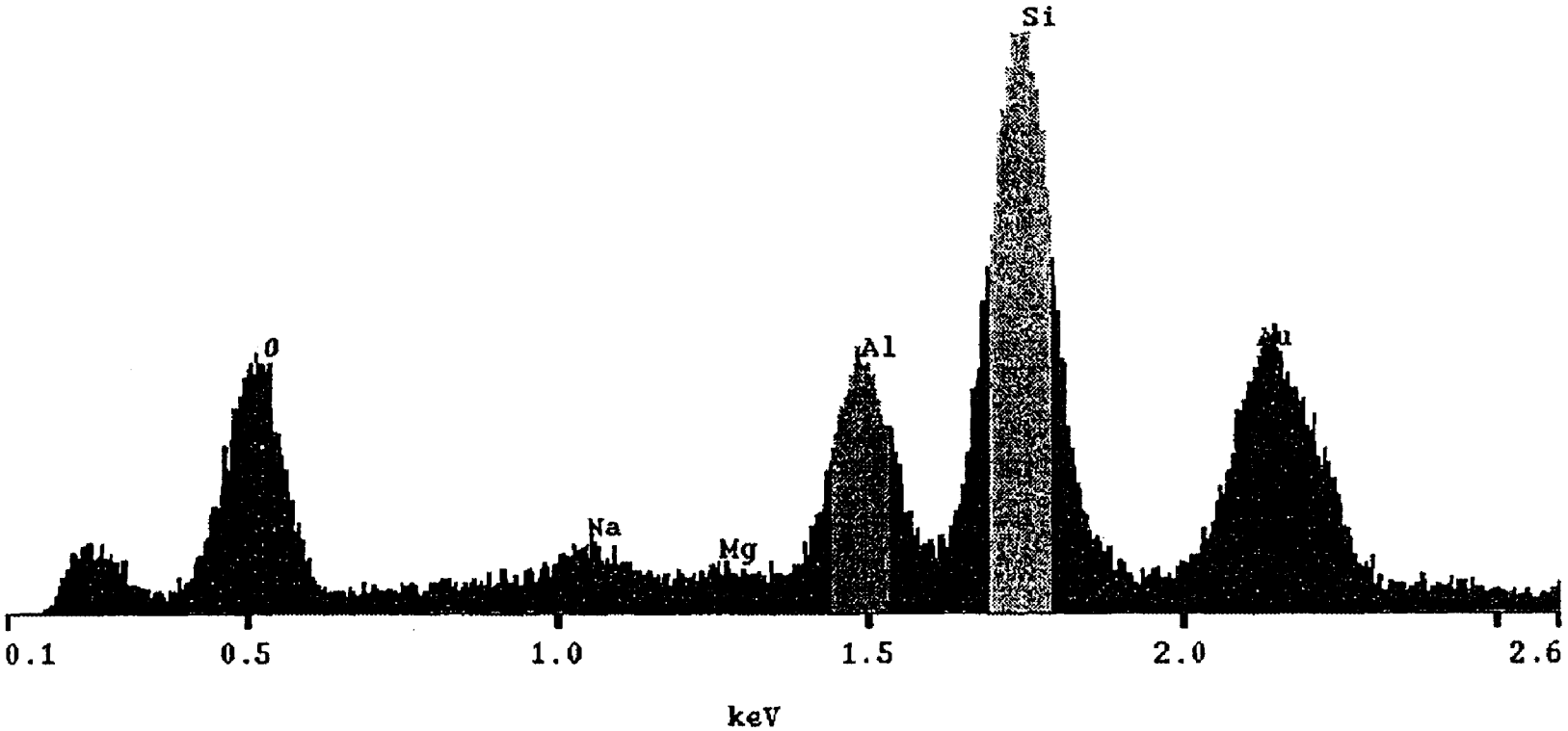

Energy dispersive x-ray spectra taken at a variety of acceleration voltages (5 kV to 25 kV) showed that the material elementally comprises aluminum, silicon, oxygen, with traces of magnesium, sodium, and carbon. Below 15 kV the contribution to the aluminum peak from the substrate becomes negligible. An example of a 10 kV energy dispersive x-ray spectra is shown in FIG. 16. The gold peak is present due to the thermally evaporated conductive coating, necessitated by the insulating nature of the film. In some regions there appears to be more silicon than aluminum (FIGS. 17–18), and in others the reverse is true (FIG. 16).

Figure 19:
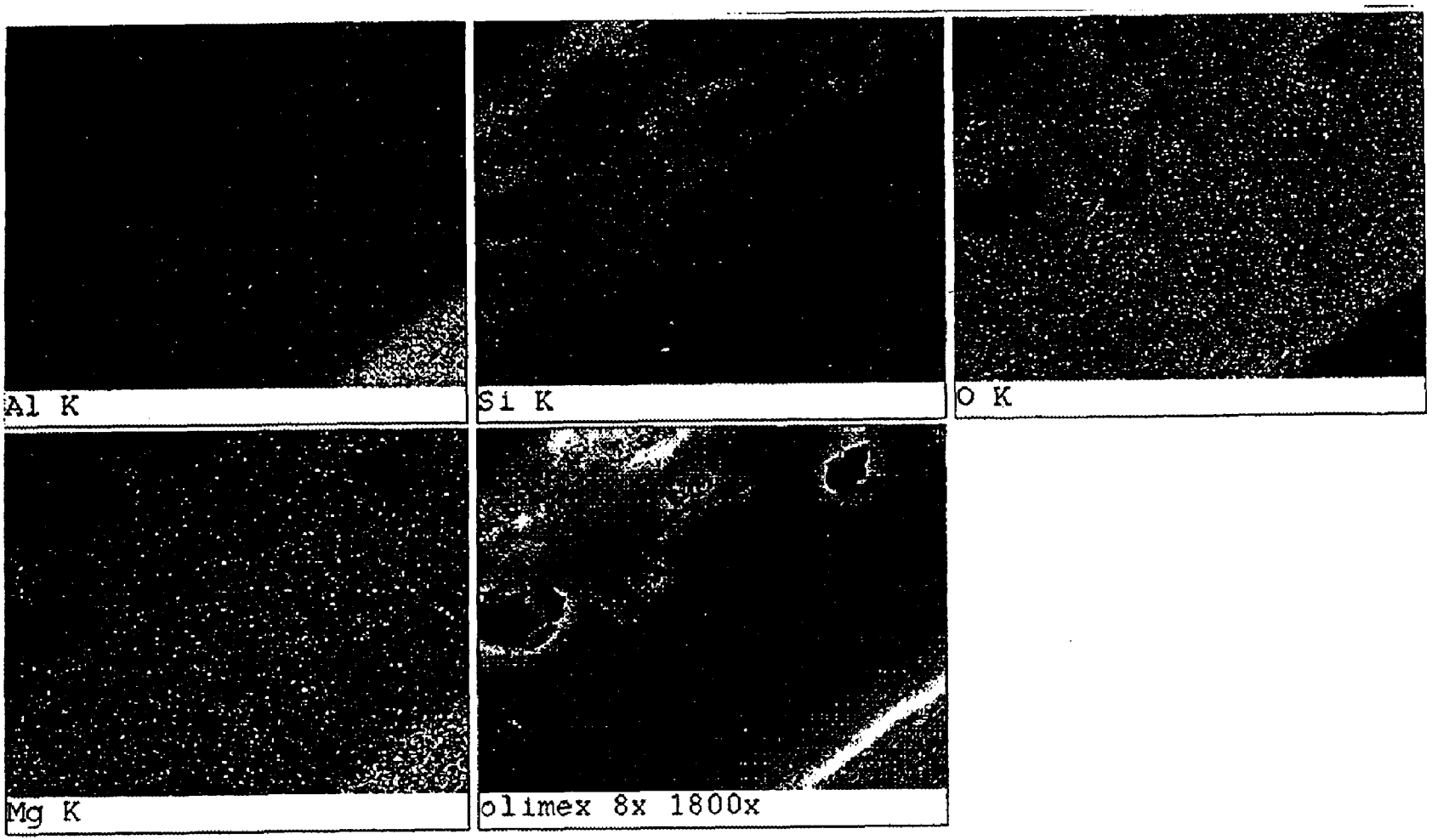
FIGS. 19–21 show digital x-ray maps of the ceramic coating surface.
Figure 20:
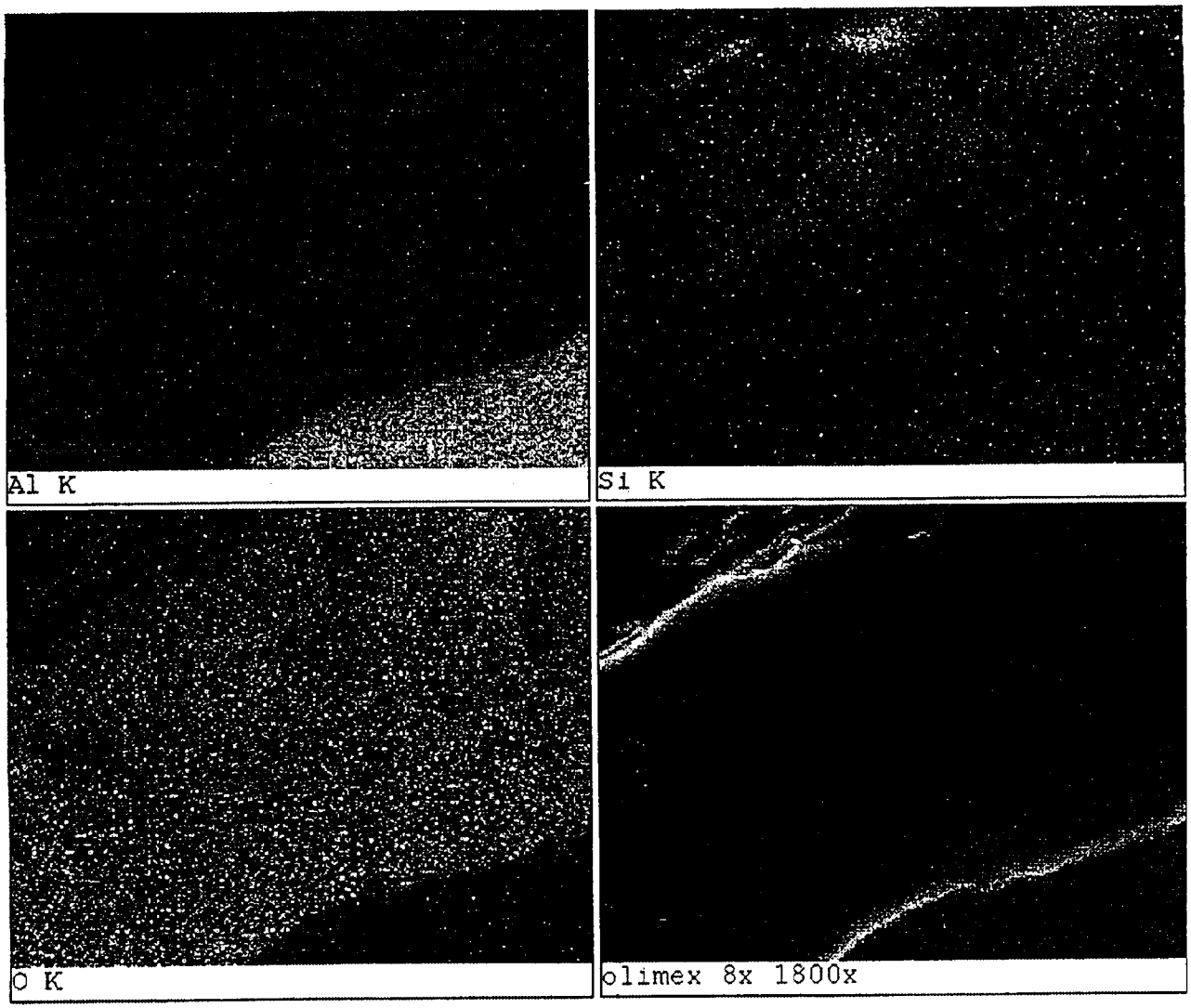
Figure 21:
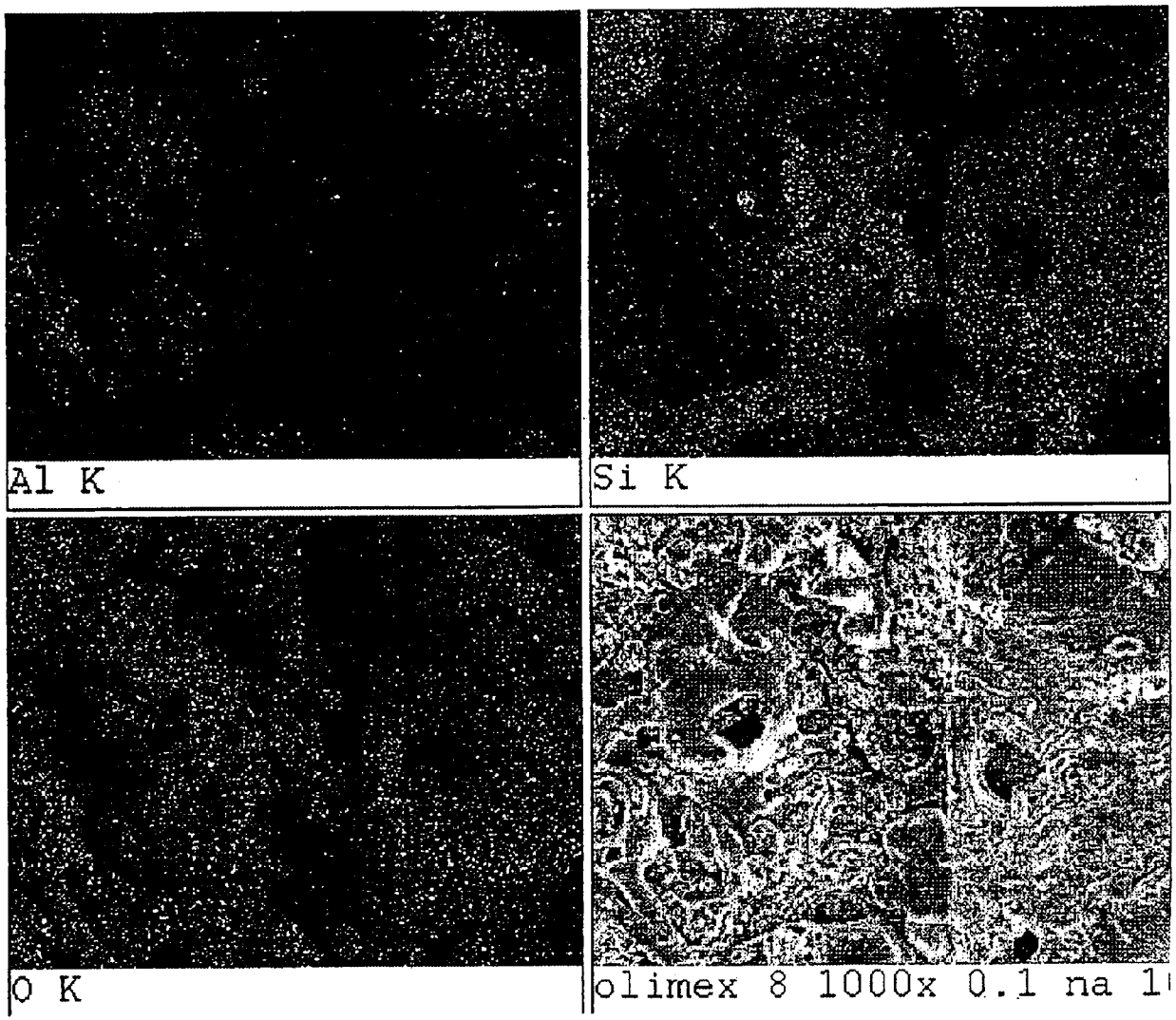

FIGS. 19–21 show digital x-ray maps of the ceramic coating, which reveal a rather uniform distribution of oxygen (ignoring topographic effects). Aluminum and silicon on the other hand tend to be spatially complementary in their distributions, suggesting the presence of separate regions of aluminum and silicon oxides, as opposed to a single alumino-silicate compound. In the ceramic coating, the silicon concentration increases towards the surface of the coating as evidenced, for example, by a disproportionate increase in the silicon signal observed with decreasing acceleration voltage.

Figure 22:
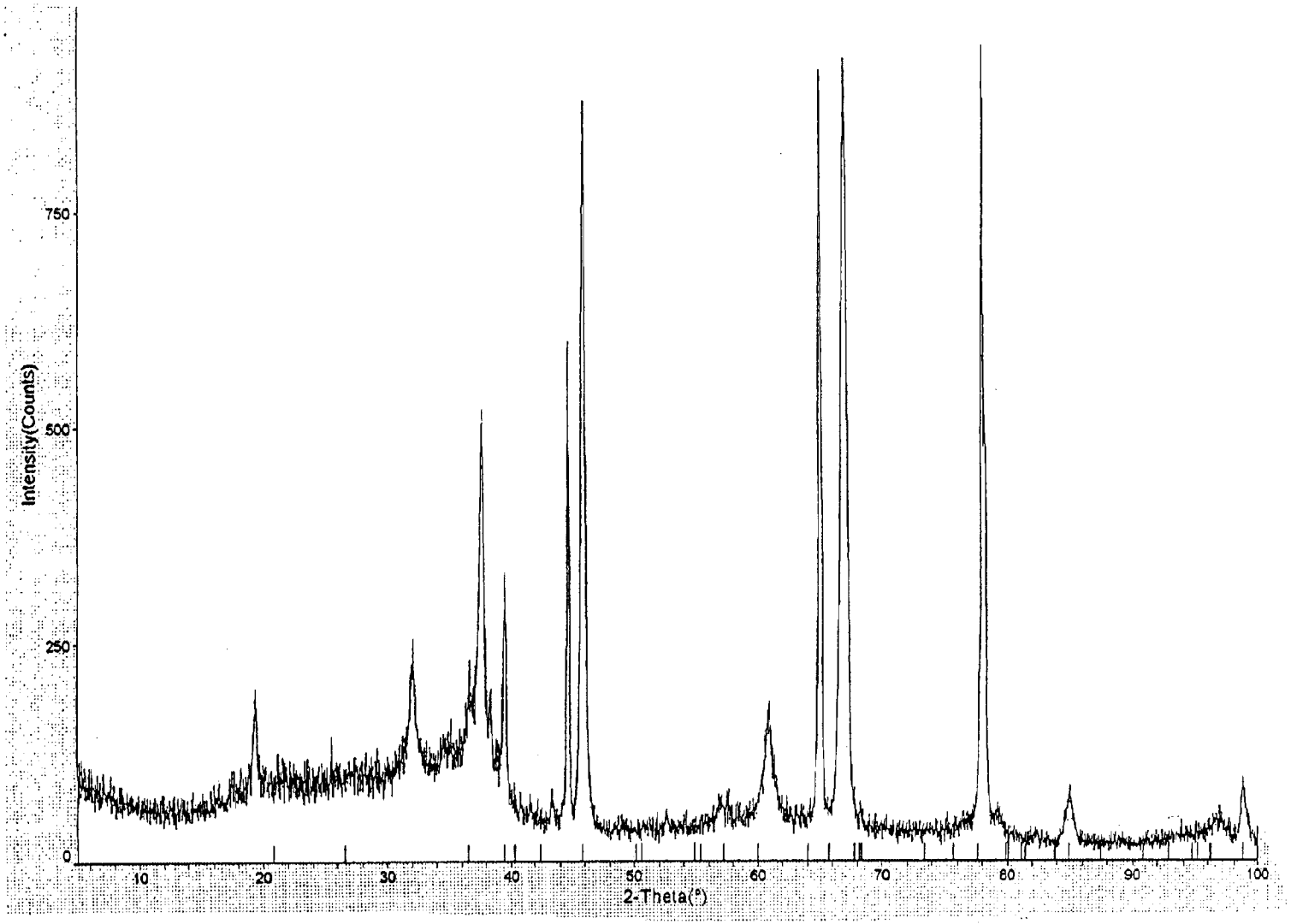
FIG. 22 shows an example of X-ray diffraction spectrum for the ceramic coating.
Figure 23:
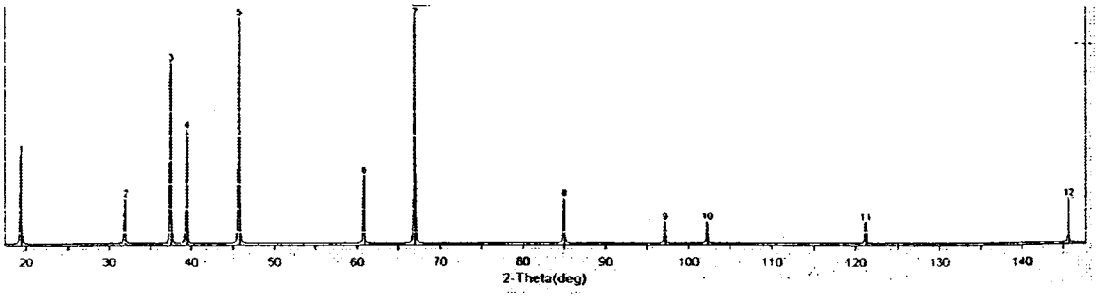
FIGS. 23–24 show X-ray diffraction spectrums for two different crystalline phases of aluminum oxide in the ceramic coating.
Figure 24:
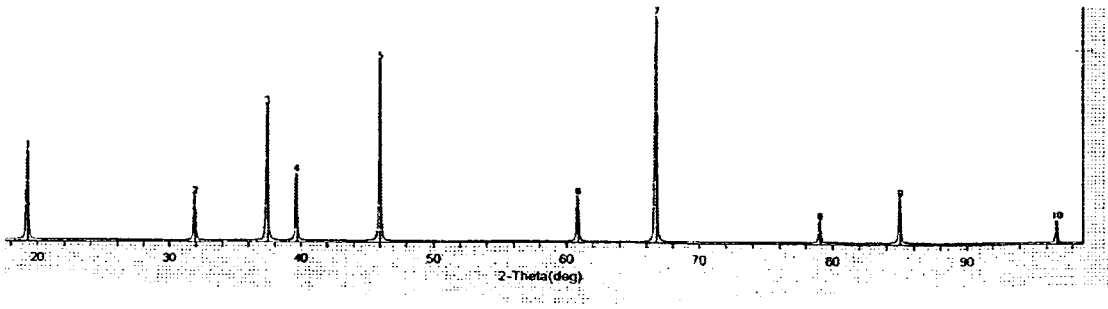

An example of an x-ray diffraction spectrum from the coating is shown in FIG. 22. Comparison of this data with the JCPDS (Joint Committee on Powder Diffraction Standards) powder diffraction files suggests the presence of at least two different crystalline phases of aluminum oxide. The x-ray diffraction data for these two phases is shown in FIGS. 23–24, data for which is presented in Tables 1 and 2, respectively.

TABLE 1

| No. of Reflection | d(Å) | I(f) | h | k | l | 2-Theta |
|---|---|---|---|---|---|---|
| 1 | 4.5600 | 40 | 1 | 1 | 1 | 19.450 |
| 2 | 2.8000 | 20 | 2 | 2 | 0 | 31.936 |
| 3 | 2.3900 | 80 | 3 | 1 | 1 | 37.603 |
| 4 | 2.2800 | 50 | 2 | 2 | 2 | 39.491 |
| 5 | 1.9770 | 100 | 4 | 0 | 0 | 45.862 |
| 6 | 1.5200 | 30 | 5 | 1 | 1 | 60.897 |
| 7 | 1.3950 | 100 | 4 | 4 | 0 | 67.032 |
| 8 | 1.1400 | 20 | 4 | 4 | 4 | 85.015 |
| 9 | 1.0270 | 10 | 7 | 3 | 1 | 97.186 |
| 10 | 0.9890 | 10 | 8 | 0 | 0 | 102.310 |
| 11 | 0.8840 | 10 | 8 | 4 | 0 | 121.234 |
| 12 | 0.8060 | 20 | 8 | 4 | 4 | 145.757 |

Table 1 shows spacing (d Å)), intensity (I), and Miller indices (h, k, l) results for fixed-slit intensities over a 2-Theta range of 17.45 to 147.76 degrees with a step size of 0.02 degrees. CuK radiation was used having a wavelength of 1.5418 Å. Table 2 shows similar results for fixed-slit intensities over a 2-Theta range of 17.28 to 98.81 degrees with a step size of 0.02 degrees. CuK $_1$radiation was used having a wavelength of 1.54056 Å.

TABLE 2

| No. of Reflection | d(Å) | I(f) | 2-Theta |
|---|---|---|---|
| 1 | 4.6000 | 40 | 19.279 |
| 2 | 2.8000 | 20 | 31.936 |
| 3 | 2.4000 | 60 | 37.441 |
| 4 | 2.2700 | 30 | 39.672 |
| 5 | 1.9700 | 80 | 46.034 |
| 6 | 1.5200 | 20 | 60.897 |
| 7 | 1.4000 | 100 | 66.762 |
| 8 | 1.1400 | 10 | 79.077 |
| 9 | 1.2100 | 20 | 85.015 |
| 10 | 1.0300 | 10 | 96.808 |

The presence of additional crystalline compound, aluminum oxide nitride, was ruled out due to the lack of a nitrogen peak in the energy dispersive x-ray spectra. The sharpness of the diffraction peaks is also suggestive of grain sizes in the sub-micron to micron range. No crystalline silicon compounds matched the diffraction data. However, the broad and diffuse background intensity in the 20 to 40 degree range suggests the presence of an amorphous phase. Given the silicon content of the material and its spatial proximity with oxygen, this phase may be vitreous silica.

Film hardness testing superficial Rockwell hardness measurements (15N scale) and micro-hardness experiments using a Vickers diamond indenter revealed either no indentation at loads less than about 100 gms or over penetration at high loads between about 100 gms and 2100 gms, indicating that the surface layer is a relatively hard, thin material (i.e., the ceramic coating) on top of a softer layer (i.e., the substrate). At low loads, the indenter did not penetrate into the hard material. At high loads above about 100 gms, the soft substrate gave way and crushed the ceramic coating. However, even when crushed, the coating adhered to the substrate and there were no fracture lines emanating from the corners of the indentation. This suggests good adhesion and some limited ductility.

Cursory examination of corrosion properties was performed by depositing droplets of various acids and bases on the surface of the ceramic material. The ceramic material was examined visually for several minutes for evidence of any reaction. Concentrated acids tested included: 37% hydrochloric, 96% sulfuric, 70% nitric, 85% phosphoric, glacial acetic, and 49% hydrofluoric. Other media tested included: 30% hydrogen peroxide, 30% ammonium hydroxide, and 40% ammonium fluoride. Only the hydrofluoric acid produced any visible reaction and etching of the coating.

Finally, electrical measurements employing a four-point probe and picoammeter show the coating to be highly resistively electrically, beyond the range of the instrumentation, placing the sheet resistivity at a value above 100 billion Ω/square meter.

The oxide coating formed on a metal (e.g., aluminum or aluminum alloys) in accord with the present invention exhibits properties dramatically superior to the properties of oxide coatings formed on a metal employing conventional electrochemical deposition techniques. For example, the ceramic oxide coating of the invention formed on aluminum or aluminum alloys exhibits a highly uniform thickness, an extremely high hardness, high insulating properties and high wear resistance. Typically, the hardness of the ceramic oxide coating of the invention formed on aluminum and aluminum alloys is about 1.5 to about 2 times that of the hardness of conventional ceramic oxide coatings formed on aluminum or aluminum alloys. The significant advantages of the present invention include ceramic coatings having an extremely high and uniform hardness, such as a hardness of about 1,000 to 2,400 $Kg/mm^2$, e.g., a hardness of about 1,700 $Kg/mm^2$.

Figure 25A:
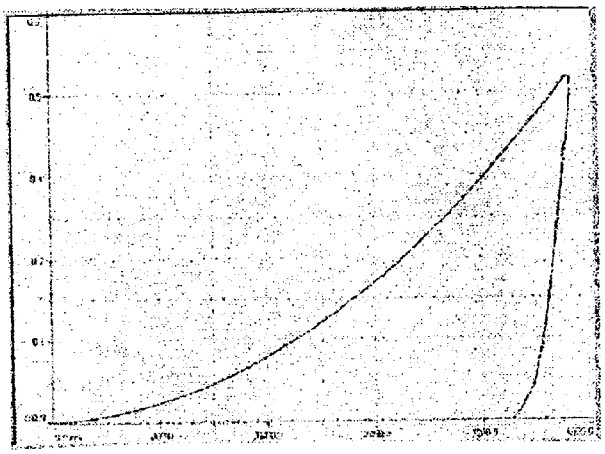
FIGS. 25(*a*)–25(*c*) show measurements of the microhardness of an article bearing the ceramic coating of the invention under loading and unloading.
Figure 25B:
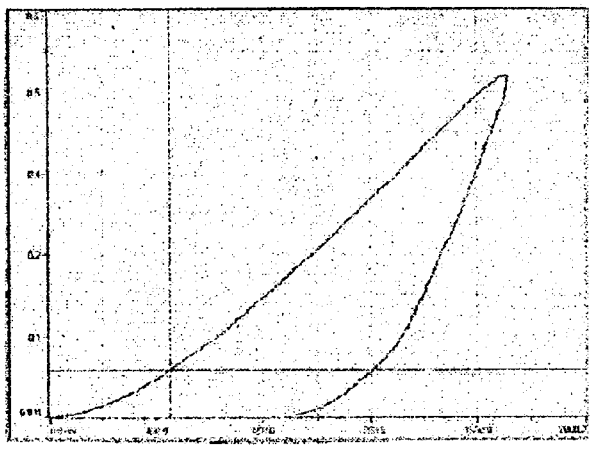
Figure 25C:
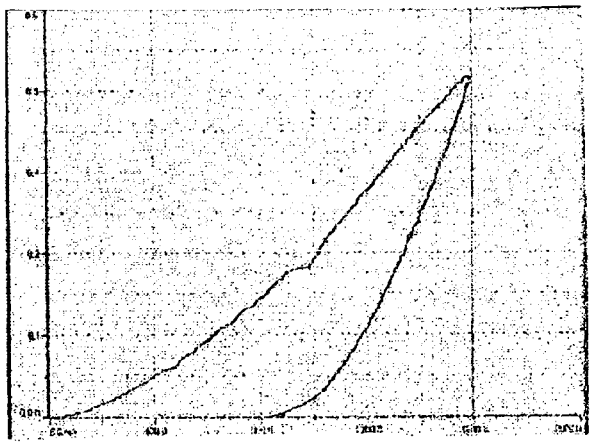

One example of an article bearing the ceramic coating described herein is shown in FIGS. 25(*a*)–30(*c*), which set forth test data for a ring-shaped aluminum-coated test coupons having an axial bore formed therein (a 6061-T6 aluminum). The test coupons were processed in accord with the above disclosure utilizing six time variants during the coating process: (1) nominal; (2) 10% less than nominal; (3) 20% less than nominal; (4) 10% more than nominal; (5) 20% more than nominal; and (6) 30% more than nominal. In the test data, the "nominal" value was selected to serve only as a point of comparative reference for different time variants to permit investigation of the relation between the coating time and the resulting coating properties, such as but not limited to thickness and hardness. In other words, the "nominal" time value serves only as a test reference, as would be understood by those skilled in the art, and does not relate directly to actual industrial applications of the disclosed process. The ceramic coating thickness was determined to average between about 13–64 μm (0.0005–0.0025") thickness throughout all test coupons with the test coupons subjected to longer coating processes (e.g., time variant (6)) having expectedly thicker ceramic coatings than those test coupons having shorter coating processes (e.g., time variant (3)). In all test coupons, a homogenous ceramic coating was formed, the ceramic coating having a general micro-porosity throughout the surface, but not allowing exposure to the base material.

As shown in FIGS. 25(*a*)–25(*c*), the microhardness was measured (averaging 5 measurements in each zone) using a Vickers diamond indentor under a loading and unloading rate of 0.5N/min to a max load of 0.5N. FIGS. 25(*a*)–25(*c*) show the displacement (nm) (x-axis) as a function of an applied normal force (N) (y-axis). FIG. 25(*a*) depicts the microhardness of the substrate (dural) as 123.64 mHV (Standard Deviation (SD) 4.97). FIG. 25(*b*) depicts the microhardness of the amorphic zone as 724.24 mHV (SD 42.13). FIG. 25(*c*) depicts the microhardness of the crystalline zone as 709.4 mHV (SD 89.09). The x-axis is scaled for displacements between 0 and 4000 nm in FIG. 25(*a*) and is scaled for displacements between 0 and 2000 nm in FIGS. 25(*b*) and 25(*c*). The y-axis is scaled for forces between 0.0 N and 0.6 N in each of the above figures.

Figure 26A:
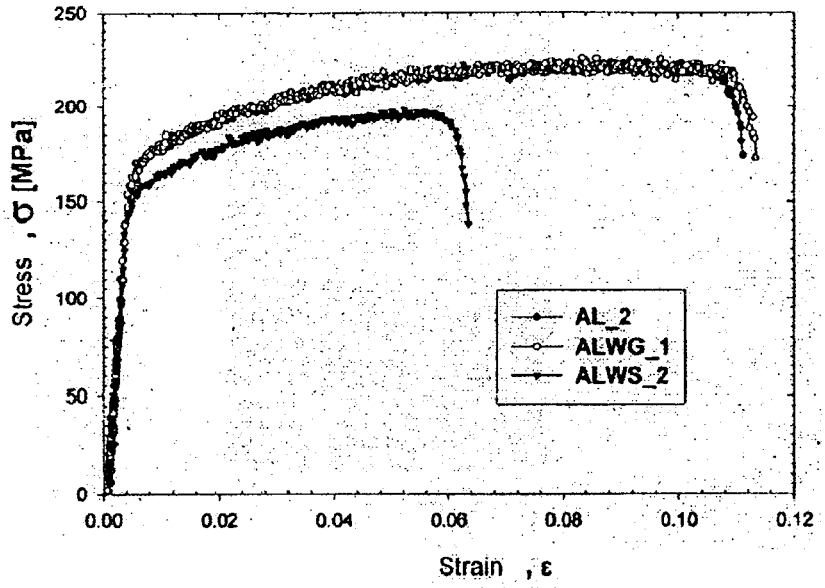
FIGS. 26(*a*)–26(*b*) depict, respectively, tensile strength plots vs. strain $\epsilon$ and bending plots vs. deflection for various uncoated and coated articles.
Figure 26B:
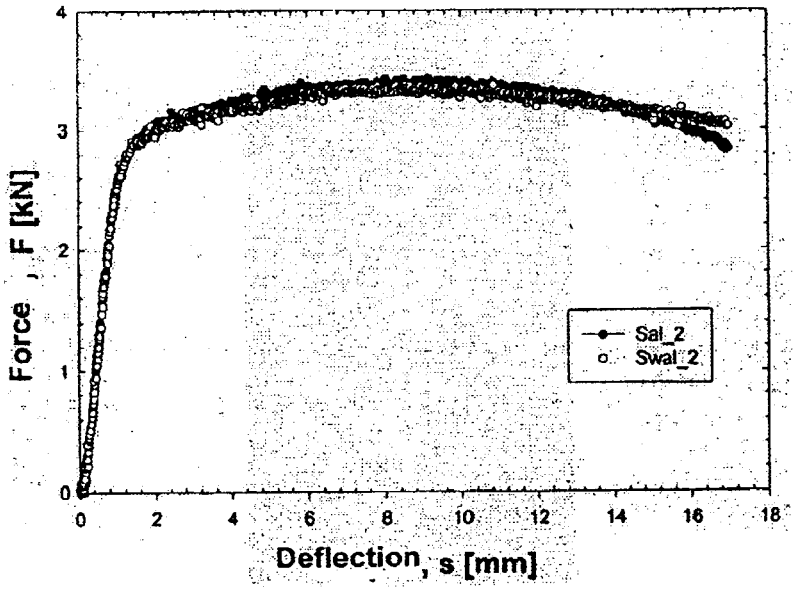
Figure 27A:
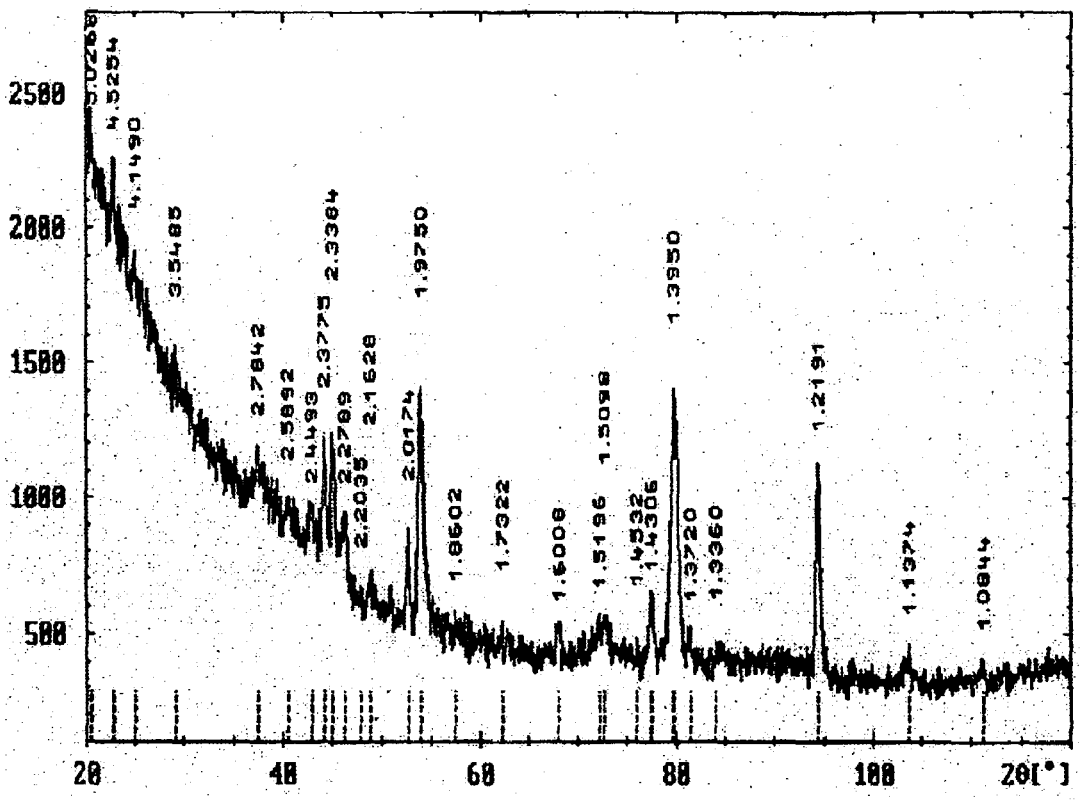
FIGS. 27(*a*)–27(*e*) show results for x-ray analysis testing of a ceramic coating in accord with the invention.
Figure 27B:
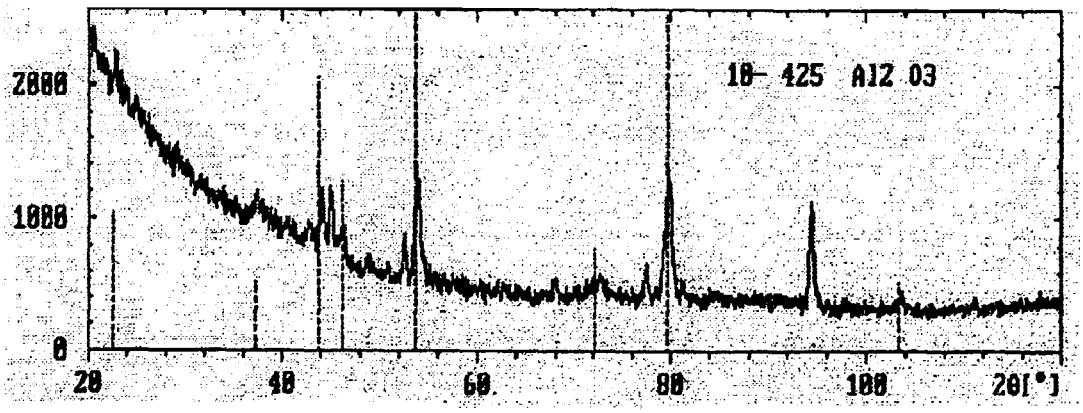
Figure 27C:
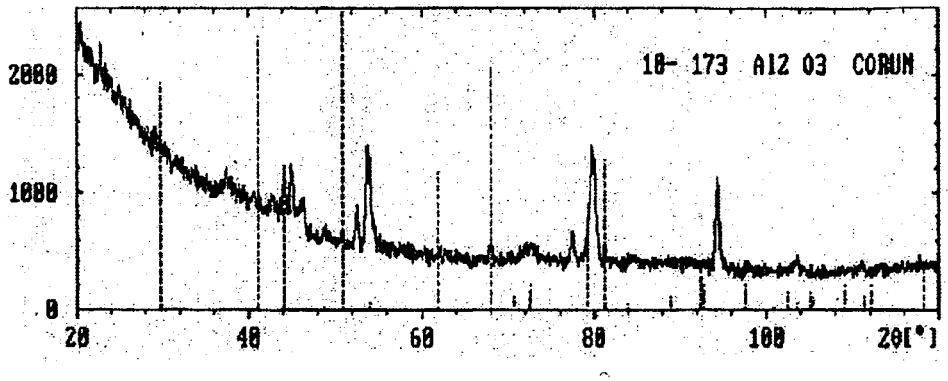
Figure 27D:
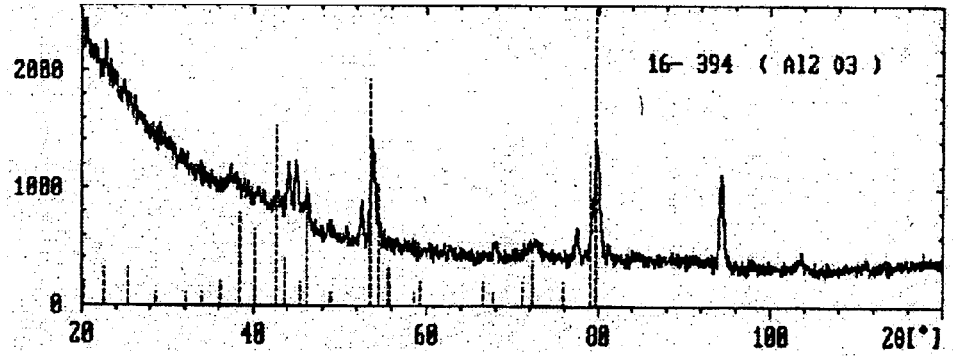
Figure 27E:
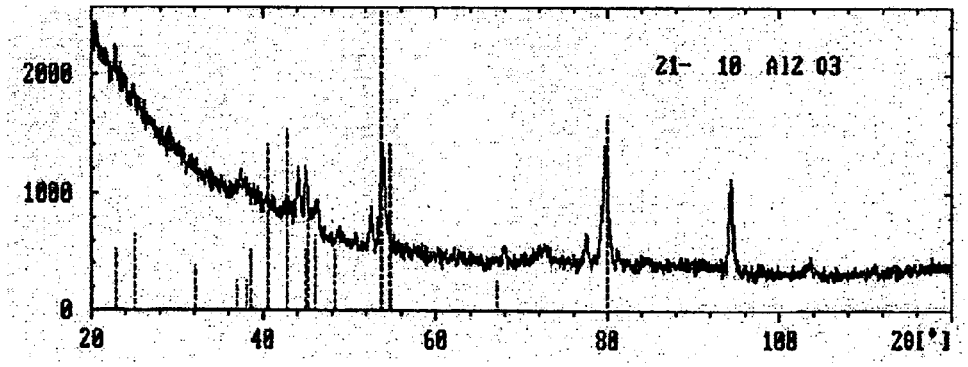

FIG. 26(*a*) shows tensile strength plots (stress σ (MPa) vs. strain ϵ (m)) for AL_2 (uncoated sample); ALWG_1 (sample with smooth coating); and ALWG_2 (sample with coarse coating). FIG. 26(*b*) shows bending plots (force F (kN)) vs. deflection s (mm) for Sal_2 (uncoated sample) and Swal_2 (coated sample).

FIG. 27(*a*) shows results for x-ray analysis testing of the ceramic coating using a standard 20 diffraction spectra wherein intensity is represented by the vertical or y-axis and the detector angle on the horizontal or x-axis. These results are further depicted in FIGS. 27(*b*)–27(*e*), which respectively isolate and illustrate contributions from various crystalline phases of alumina identified in the coating, shown by the peak distributions and corresponding vertical dashed lines, in a manner well-known to those skilled in the art.

Figure 28A:
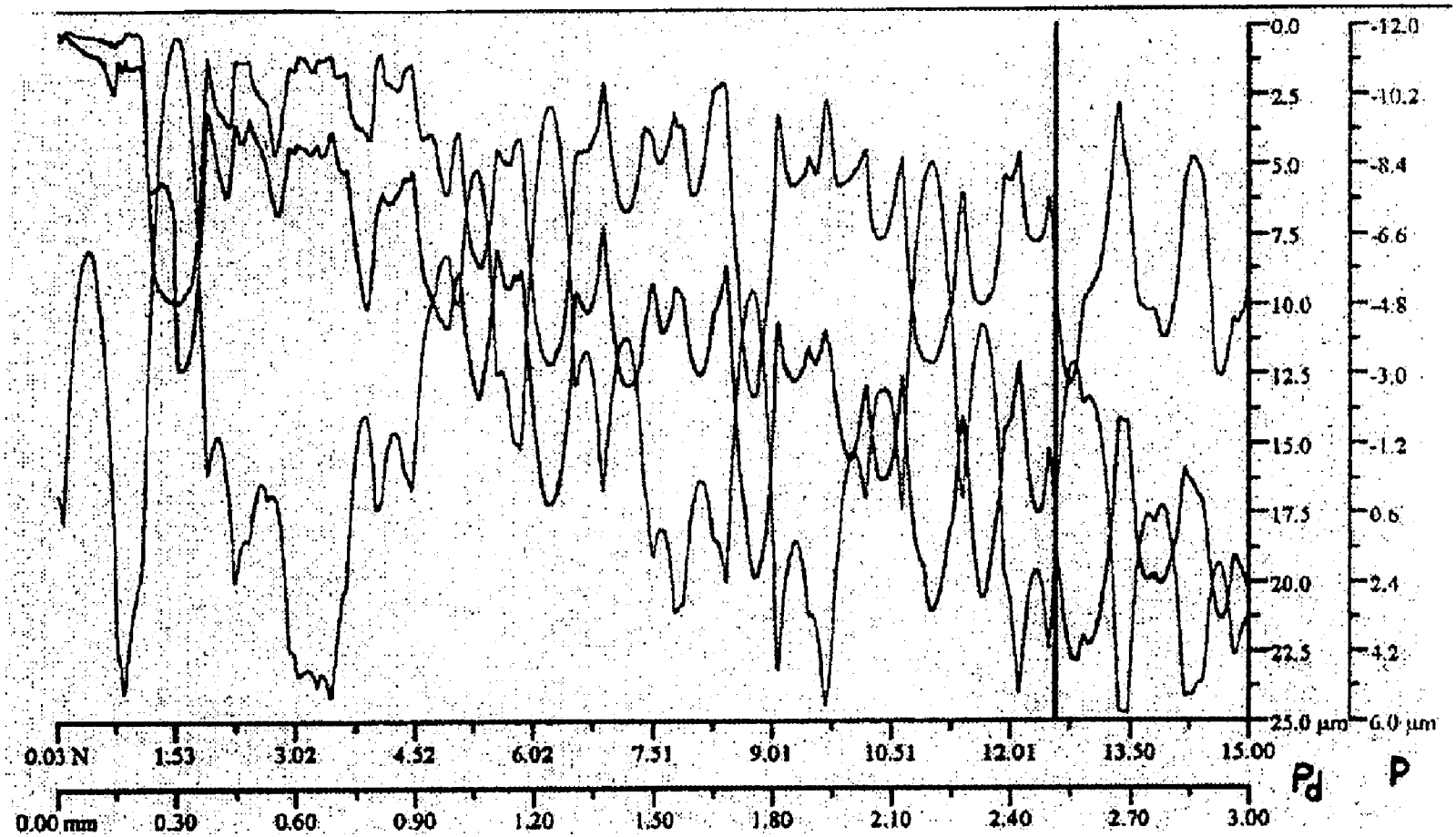
FIGS. 28(*a*)–28(*b*) show results of scratch tests for a ceramic coated articles in accord with the invention.
Figure 28B:
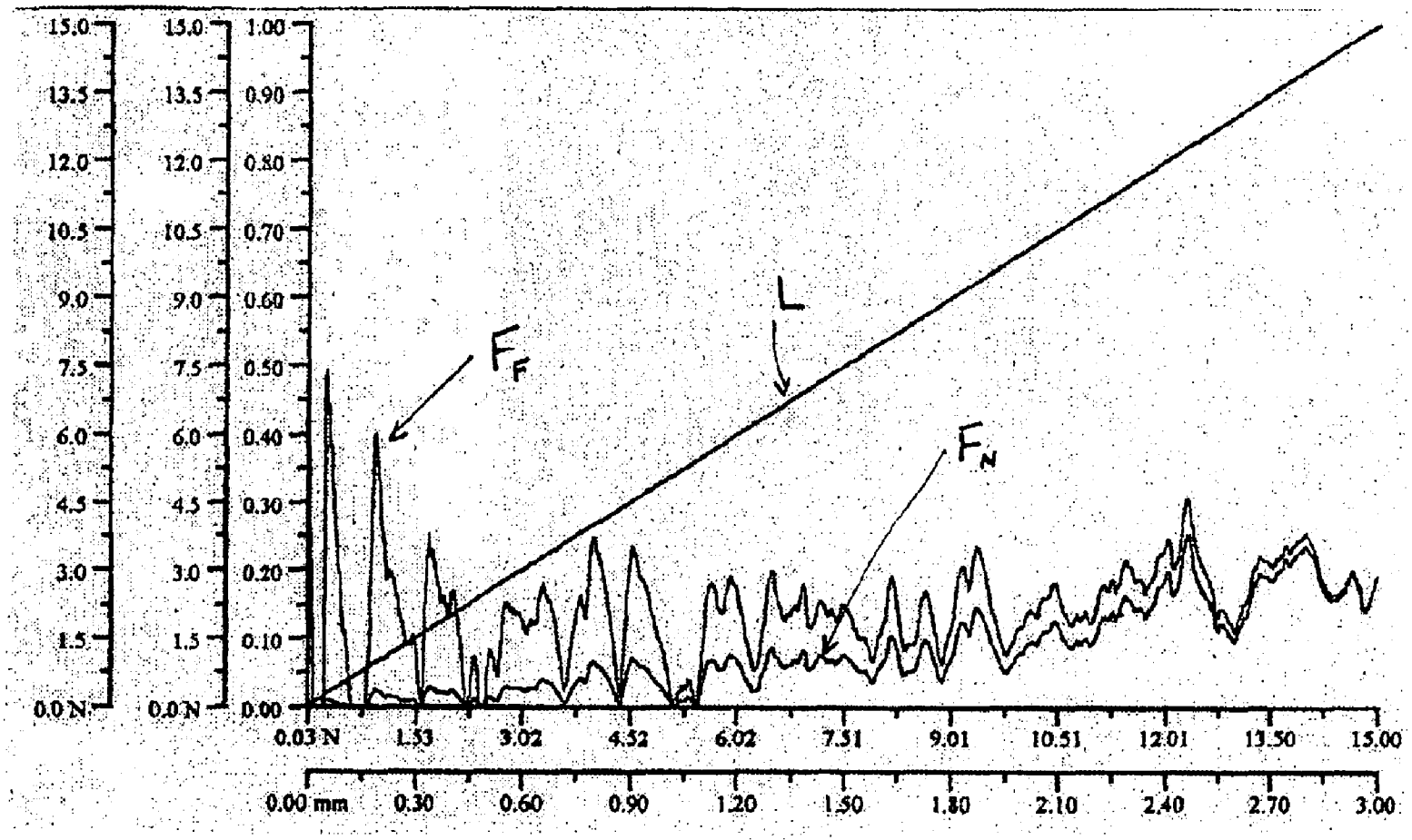

FIGS. 28(*a*)–28(*b*) show results of scratch tests for a ceramic coated article in accord with the invention. The x-axis of FIG. 28(*a*) show scales for the applied load, which started at 0.03 N at the starting point of the scratch (i.e., 0.00 mm) and increased to a final load of 15 N at the end of the scratch length at 3.00 mm, shown as a separate scale along the x-axis. The penetration depth Pd is shown along the y-axis and ranges from 0.0 μm to 25.0 μm. The surface profile P is shown along the y-axis and ranges from −12.0 μm to +6.0 μm. FIG. 28(*b*) shows measured normal and frictional forces for the scratch test depicted in FIG. 28(*a*). Along the y-axis, starting from the outer or leftmost scale, are scales for the load L applied during the test, ranging from 0.0 N to 15.0 N at a loading rate of 14.97 N/min, the normal force $F_N$ (0.0 N to 15.0 N), and the frictional force $F_F$ (0.0 to 1.00). The x-axis of FIG. 28(*b*) shows scales for the applied load, which started at 0.03 N at the starting point of the scratch (i.e., 0.00 mm) and increased to a final load of 15 N at the end of the scratch length at 3.00 mm, and for the scratch length itself.

Figure 29:
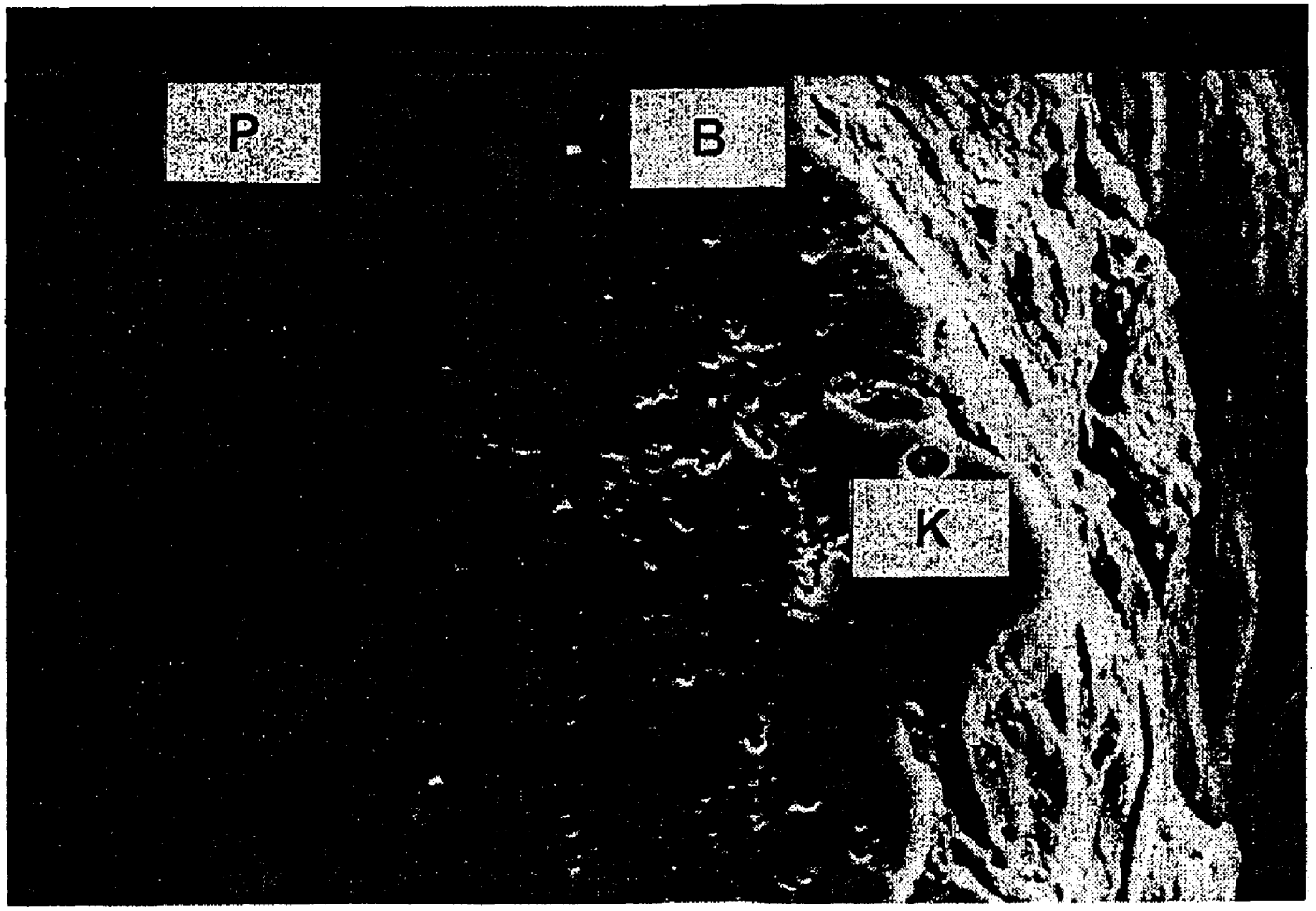
FIG. 29 shows a scanning electron microscope (SEM) image of a ceramic coated layer in accord with the invention.

FIG. 29 shows a scanning electron microscope (SEM) image of the coated layer structure at a magnification of 1120×. Reference numeral P represents the substrate (dural), reference numeral B represents the amorphic zone, and reference numeral K represents the crystalline zone. The sample was cut at a 30° angle and the image was taken at the corner of the sample to provide view of sample surface as well as underlying layers. As evident in FIG. 29, the coated layer has two zones, amorphic and crystalline.

Figure 30A:
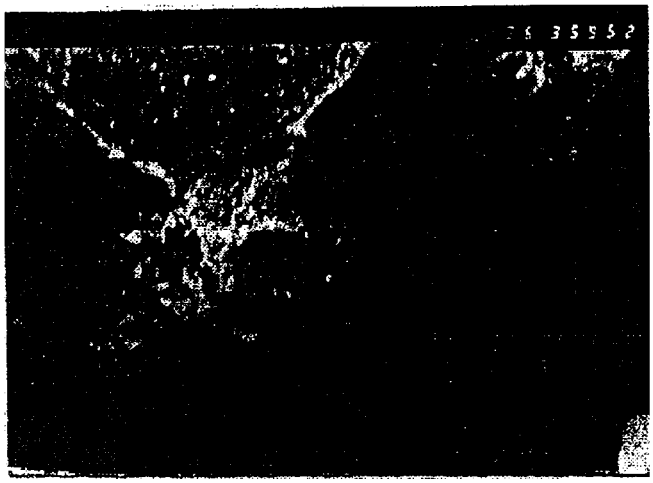
FIGS. 30(*a*)–(*c*) show pictures from a transmission electron microscope (TEM) respectively showing the structure of the aluminum substrate and amorphic zone (FIG. 30(*a*)), diffraction from the substrate (FIG. 30(*b*)), and diffraction from the substrate and amorphic zone (FIG. 30(*c*)).
Figure 30B:
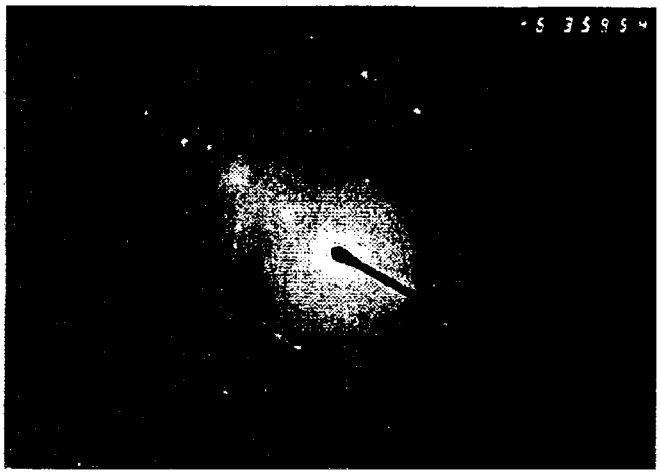
Figure 30C:
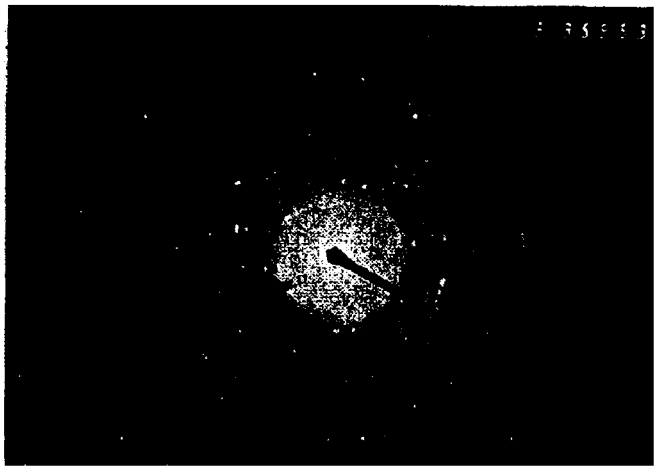

FIGS. 30(*a*)–30(*c*) show pictures from a transmission electron microscope (TEM) respectively showing the structure of the aluminum substrate and amorphic zone at a magnification of 26,000× (FIG. 30(*a*)), diffraction from the substrate (FIG. 30(*b*)), and diffraction from the substrate and amorphic zone (FIG. 30(*c*)).

The ceramic oxide coatings of the invention can also be formed at a substantially reduced thickness, such as about 10 microns to about 25 microns, e.g., about 15–20 microns up to any desired thickness, such as about 150 microns. The ceramic coating also exhibits high insulative properties and can withstand degradation, such as melting or decomposition, at temperatures up to 2,000° C.

Significantly, because of the particular electrochemical deposition technique employed, the properties of the coating are extremely uniform. Thus, ceramic coatings in accord with the invention exhibit high uniform elasticity, in that the elasticity of the aluminum substrate or aluminum alloy substrate can be increased ten-fold. The ceramic coatings in accord with the present invention also exhibit uniform density, thickness, corrosion resistance and hardness.

The ceramic coating in accord with the present invention also exhibits superior insulative properties and can be used in high-temperature environments without decomposition or melting. Such electrical insulative properties find particularly utility in various industrial applications.

Further, the uniformity of thickness of the coatings formed in accordance with the present invention is superior to that obtainable by conventional techniques. In accord with the conventional techniques, the thickness of a ceramic coating can vary by as much as about 20%. In contrast, the present invention yields a ceramic coating having a thickness that varies by less than about 5%.

The superior properties in accord with the present invention lends the process to numerous industrial applications. For example, articles containing ceramic coatings in accord with the present invention can be used to form non-magnetic substrates for magnetic recording, particularly those employing an aluminum or aluminum alloy layer with ceramic oxide coating on each surface thereof.

The high strength coatings of the present invention render the articles suitable for use in piping. The lack of friction and high hardness of the ceramic coatings in accordance with the present invention render the inventive articles suitable for use in pumps, transformers, engine components such as turbine blades, semiconductor manufacturing, engine housings, pipings, rings, abrasives, ship building, medical implants, food processing, chemical handling equipment and cookware. The significant use of the articles produced in accordance with the present invention is in jet fuel tanks which can be subjected to a higher pre-treat temperature without rupturing, thereby reducing overall fuel consumption.

The ceramic coatings in accordance with the present invention render the composite articles suitable for use in automotive engines, particularly in components which would require high lubrication but, because of the reduced friction of the ceramic coatings of the present invention, such articles can be employed with minimum lubrication.

Articles produced in accordance with the present invention also exhibit reduced coefficients of friction, which render such articles suitable in applications sensitive to coefficients of frictions, such as aeronautical applications.

The high hardness and wear resistance of the ceramic coatings render the inventive article suitable for use in magnetic pumps, the articles typically having a ceramic coating with a thickness of about 150 microns.

While the foregoing has described what are considered to be preferred embodiments of the invention it is understood that various modifications may be made therein and that the invention may be implemented in various forms and embodiments, and that it may be applied in numerous applications, only some of which have been described herein. It is intended by the following claims to claim all such modifications and variations which fall within the true scope of the invention.

What is claimed is:

1. A method for forming a ceramic coating on an electrically conductive article, the method comprising:

immersing a first electrode comprising said electrically conductive article in an electrolyte comprising an aqueous solution of a metal hydroxide and a metal silicate;

providing a second electrode comprising one of the vessel containing the electrolyte or an electrode immersed in the electrolyte;

passing an alternating current from a resonant power source through the first electrode as an anode and to the second electrode as a cathode while maintaining the angle $\phi$ between the current and the voltage at zero degrees, and while maintaining the voltage between the first and second electrodes within a predetermined range.

2. The method for forming a ceramic coating on an electrically conductive article according to claim 1, wherein said predetermined voltage range is between about 220–1,000V.

3. The method for forming a ceramic coating on an electrically conductive article according to claim 2, wherein said aqueous solution of a metal hydroxide and a metal silicate comprises about 0.5–5 g/liter of alkali metal hydroxide and 1–500 g/liter sodium silicate.

4. The method for forming a ceramic coating on an electrically conductive article according to claim 1, further comprising adding mixed complexes to the electrolyte.

5. The method for forming a ceramic coating on an electrically conductive article according to claim 4, wherein said mixed complexes include at least one metal selected from the group consisting of Cu, Zn, Cd, Cr, Fe, Ti, and Co to serve as central atoms in the mixed complexes.

6. The method for forming a ceramic coating on an electrically conductive article according to claim 4, further comprising adding at least one phosphate to the electrolyte.

7. The method for forming a ceramic coating on an electrically conductive article according to claim 6, wherein said at least one phosphate comprises an ammonium phosphate.

8. The method for forming a ceramic coating on an electrically conductive article according to claim 1, wherein said step of passing an alternating current from a resonant power source further comprises:

changing said angle $\phi$ during said step of passing an alternating current by changing at least one of a transformer secondary winding inductance and an additional inductance in a resonant circuit or by changing a capacitance in the resonant circuit.

9. The method for forming a ceramic coating on an electrically conductive article according to claim 8, wherein said electrolyte comprises salts of metals selected from the group consisting of B, Al, Ge, Sn, Pb, As, Sb, Bi, Sc, Te, P, Ti, V, Nb, Ta, Cr, Mo, W, Mn and Fe.

10. The method for forming a ceramic coating on an electrically conductive article according to claim 8, further comprising adding at least one pigmenting substance to the electrolyte.

* * * * *